US006069543A

United States Patent [19]

Ishikawa et al.

[11] Patent Number: 6,069,543

[45] Date of Patent: May 30, 2000

[54] DIELECTRIC RESONATOR CAPABLE OF VARYING RESONANT FREQUENCY

[75] Inventors: Yohei Ishikawa, Kyoto; Toshiro Hiratsuka, Kusatsu; Sadao Yamashita, Kyoto; Kenichi Iio, Nagaokakyo, all of Japan

[73] Assignee: Murata Manufacturing Co., Ltd., Japan

[21] Appl. No.: 09/045,008

[22] Filed: Mar. 20, 1998

Related U.S. Application Data

[63] Continuation-in-part of application No. 08/716,020, Sep. 19, 1996, Pat. No. 5,786,740.

[30] Foreign Application Priority Data

Sep. 19, 1995 [JP] Japan ..... 7-240257

[51] Int. Cl.[7] ..... H01P 7/10

[52] U.S. Cl. ..... 333/219.1; 333/235

[58] Field of Search ..... 333/202, 208–210, 333/219, 219.1, 227, 231–233, 235; 334/78, 80

[56] References Cited

U.S. PATENT DOCUMENTS 4,733,198 3/1988 Blickstein et al. ..... 333/235 X
5,142,255 8/1992 Chang et al. ..... 333/219 X
5,406,233 4/1995 Shih et al. ..... 333/235 X
5,786,740 7/1998 Ishikawa et al. ..... 333/219.1

FOREIGN PATENT DOCUMENTS 1196977 12/1985 U.S.S.R. ..... 333/219

*Primary Examiner*—Seungsook Ham
*Attorney, Agent, or Firm*—Ostrolenk, Faber, Gerb & Soffen, LLP

[57] ABSTRACT

A dielectric resonator capable of adjusting a resonance frequency, reducing occurrence of a mode jump if it is applied to an oscillator and being manufactured at a low cost. The dielectric resonator has a pair of upper and lower opposing conductive plates; a dielectric substrate disposed between the conductive plates; a first electrode formed on one surface of the dielectric substrate, the first electrode having a first opening; a second electrode formed on another surface of the dielectric substrate, the second electrode having a second opening corresponding to the first opening so that a resonator is formed by a portion of the dielectric substrate disposed between the first and second openings; and a variable capacitor located in a portion of the dielectric substrate in which an applied electromagnetic field is confined in and around the resonator.

3 Claims, 15 Drawing Sheets

DIELECTRIC RESONATOR CAPABLE OF VARYING RESONANT FREQUENCY

CROSS-REFERENCE TO RELATED APPLICATION

This is a continuation-in-part of application Ser. No. 08/716,020, filed on Sep. 19, 1996 now U.S. Pat. No. 5,786,740, the disclosures of which are incorporated by reference.

BACKGROUND OF THE INVENTION

1. Field of the Invention

The present invention relates to a dielectric resonator capable of varying its resonant frequency for use in a microwave or millimeter wave band.

2. Description of the Related Art

A demand for mobile communication systems in 900 MHz and quasi-microwave bands has increased rapidly in recent years and a future deficiency of usable frequencies is therefore apprehended. Systems adapted to multimedia communications such as communication systems for transmitting images or image information are being studied. Such communication systems must be realized as large-capacity high-speed communication systems. The use of millimeter wave frequency bands which are practically unused and in which the band width and the capacity of a communication channel and the communication speed can easily be increased has been taken into consideration.

Conventionally, cavity resonators have generally been used as microwave and millimeter wave band filters for use in oscillators and filters. Recently, however, cylindrical $TE_{01d}$ mode dielectric resonators have come into wide use in place of high-priced large cavity resonators. In 1975, Wakino et al. made a practical $TE_{01d}$ mode dielectric resonator of this kind having high stability with respect to temperature by using a temperature-characteristic-compensated dielectric. In general, the temperature characteristics of $TE_{01d}$ mode dielectric resonators are determined by the temperature characteristics of the material of the resonator. Therefore, $TE_{01d}$ mode dielectric resonators have the advantage of being free from the need for using an expensive metal such as Kovar or Invar to form the cavity.

Also, variable frequency dielectric resonators have recently been studied for use in voltage controlled oscillators, for example.

FIG. 13 is a perspective view of a conventional variable frequency dielectric resonator constructed by using a $TE_{01d}$ mode dielectric resonator 301. This variable frequency dielectric resonator consists of a variable frequency microstrip line resonator MR350 having a varactor diode 304, and the $TE_{01d}$ mode dielectric resonator 301. That is, on an upper surface of a dielectric substrate 306 having a grounding conductor 307 formed on its lower surface, a strip conductor 302 and a strip conductor 303 are formed so that one end of the strip conductor 302 and one end of the strip conductor 303 face each other with a predetermined spacing. The strip conductor 302 and the grounding electrode 307 between which the dielectric substrate 306 is interposed form a microstrip line resonator MR302 while the strip conductor 302 and the grounding electrode 307 between which the dielectric substrate 306 is interposed form a microstrip line resonator MR303. The varactor diode 304 is connected in series between the strip conductors 302 and 303. Thus, the variable frequency microstrip line resonator MR350 is constituted of the microstrip line resonators MR302 and MR303 and the varactor diode 304.

The $TE_{01d}$ mode dielectric resonator 301 is placed on the upper surface of the dielectric substrate 306 close to the strip conductor 302. The $TE_{01d}$ mode dielectric resonator 301 and the variable frequency microstrip line resonator MR350 are thereby coupled with each other electromagnetically, thus constructing the conventional variable frequency dielectric resonator constituted of the $TE_{01d}$ mode dielectric resonator 301 and the variable frequency microstrip line resonator MR350.

The strip conductor 305 formed on the upper surface of the dielectric substrate 306 is placed close to the $TE_{01d}$ mode dielectric resonator 301, thereby constructing the microstrip line M305 which is constituted of the strip conductor 305 and the grounding conductor 307 with the dielectric substrate 306 interposed therebetween and which is electromagnetically coupled with the variable frequency dielectric resonator.

In the thus-constructed conventional variable frequency dielectric resonator, the resonance frequency is variable by changing the electrostatic capacity of the varactor diode 304. The electrostatic capacity of the varactor diode 304 is changed by changing a reverse bias voltage applied to the varactor diode 304. Also, an external circuit, e.g., a negative resistance circuit or the like can be connected to the resonator through the microstrip line M305.

A variable resonance frequency type of cavity resonator may also be made by providing a varactor diode in a portion of a cavity or by being arranged so that the size of a cavity is changeable.

The conventional variable frequency dielectric resonator constructed by using the $TE_{01d}$ mode dielectric resonator 301, however, has a complicated structure and is high-priced because the two resonators, i.e., the $TE_{01d}$ mode dielectric resonator 301 and the variable frequency microstrip line resonator MR350, are used. Also, the resonance frequency of the conventional variable frequency dielectric resonator cannot easily be adjusted. Further, since the conventional variable frequency dielectric resonator is constructed by using the two resonators: the $TE_{01d}$ mode dielectric resonator 301 and the variable frequency microstrip line resonator MR350, not a simple single mode but two modes, i.e., an even mode and an odd mode, occur. Therefore, if the conventional variable frequency dielectric resonator is used in an oscillator, a mode jump can occur easily from a desired resonance mode to a resonance mode different from the desired resonance mode to cause oscillation at a resonance frequency different from the desired resonance frequency. Also, cavity resonators of the variable resonance frequency type are disadvantageously large in size and high-priced.

SUMMARY OF THE INVENTION

In view of the above-described problems, an object of the present invention is to provide a variable frequency dielectric resonator capable of easily adjusting a resonance frequency, reducing occurrence of a mode jump when used in an oscillator and being manufactured at a lower cost in comparison with the conventional variable frequency dielectric resonator.

To achieve this object, according to one aspect of the present invention, there is provided a variable frequency dielectric resonator capable of resonating at a resonance frequency, comprising a dielectric substrate provided between two conductor plates facing each other and having a first surface and a second surface opposite from each other, a first electrode formed on the first surface of the dielectric substrate and having a first opening formed in a predetermined shape over a central portion of the first surface of the dielectric substrate, and a second electrode formed on the second surface of the dielectric substrate and having a second opening formed in substantially the same shape as the first opening and positioned opposite from the first opening. Spacing between the dielectric substrate and the conductor plates and a thickness and a dielectric constant of the dielectric substrate are set such that the portion of the dielectric substrate other than a resonator formation region between the first opening and the second opening, interposed between the first and second electrodes, attenuates a high-frequency signal having the same frequency as the resonance frequency. The variable frequency dielectric resonator also comprises a slit formed in at least one of the first and second electrodes so as to connect with the corresponding one of the first and second openings, a third electrode formed in the slit in such a manner as to be insulated from the first and second electrodes, and a variable capacitance connected between the first or second electrode and the third electrode in the vicinity of the position at which the first or second opening connects with the slit, the electrostatic capacitance thereof being variable according to a change in a voltage applied between the first or second electrode and the third electrode. The resonance frequency of the dielectric resonator is changed by changing the voltage applied between the first or second electrode and the third electrode.

According to another aspect of the present invention, in the above-described variable frequency dielectric resonator, the variable capacitance has a fixed electrode and a movable electrode each formed as a thin-film conductor. The fixed electrode and the movable electrode are supported on an insulating base so as to face each other through a cavity formed in the insulating base.

According to still another aspect of the present invention, in the above-described variable frequency dielectric resonator, the variable capacitance comprises a varactor diode.

These and other objects, features and advantages of the present invention will become apparent from the following detailed description of embodiments of the invention with reference to the accompanying drawings.

BRIEF DESCRIPTION OF THE DRAWINGS

FIG. 6(*b*) is a cross-sectional view taken along the line B-B' of FIG. 6(*a*).

DESCRIPTION OF EMBODIMENTS OF THE INVENTION

First Embodiment

Figure 1A:
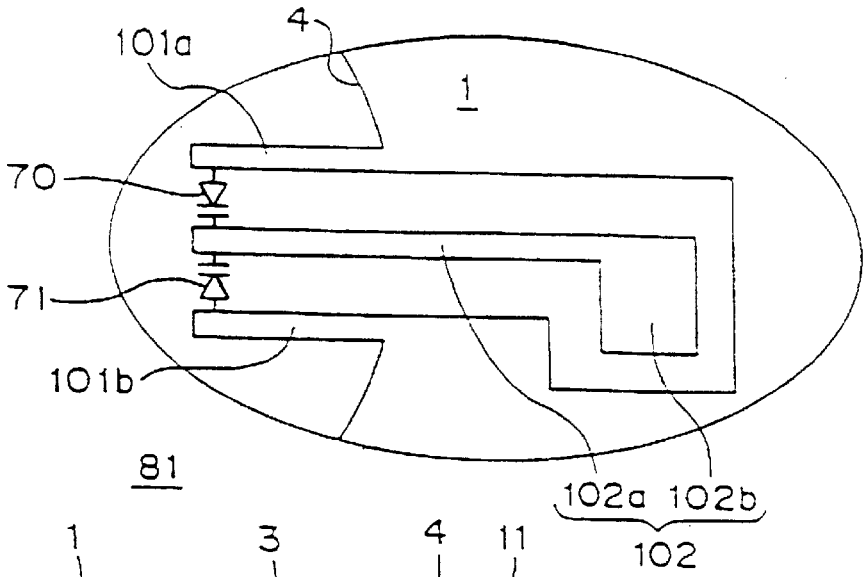
FIG. 1 is a cross-sectional view of a variable frequency dielectric resonator 81 which represents a first embodiment of the present invention.
Figure 1:
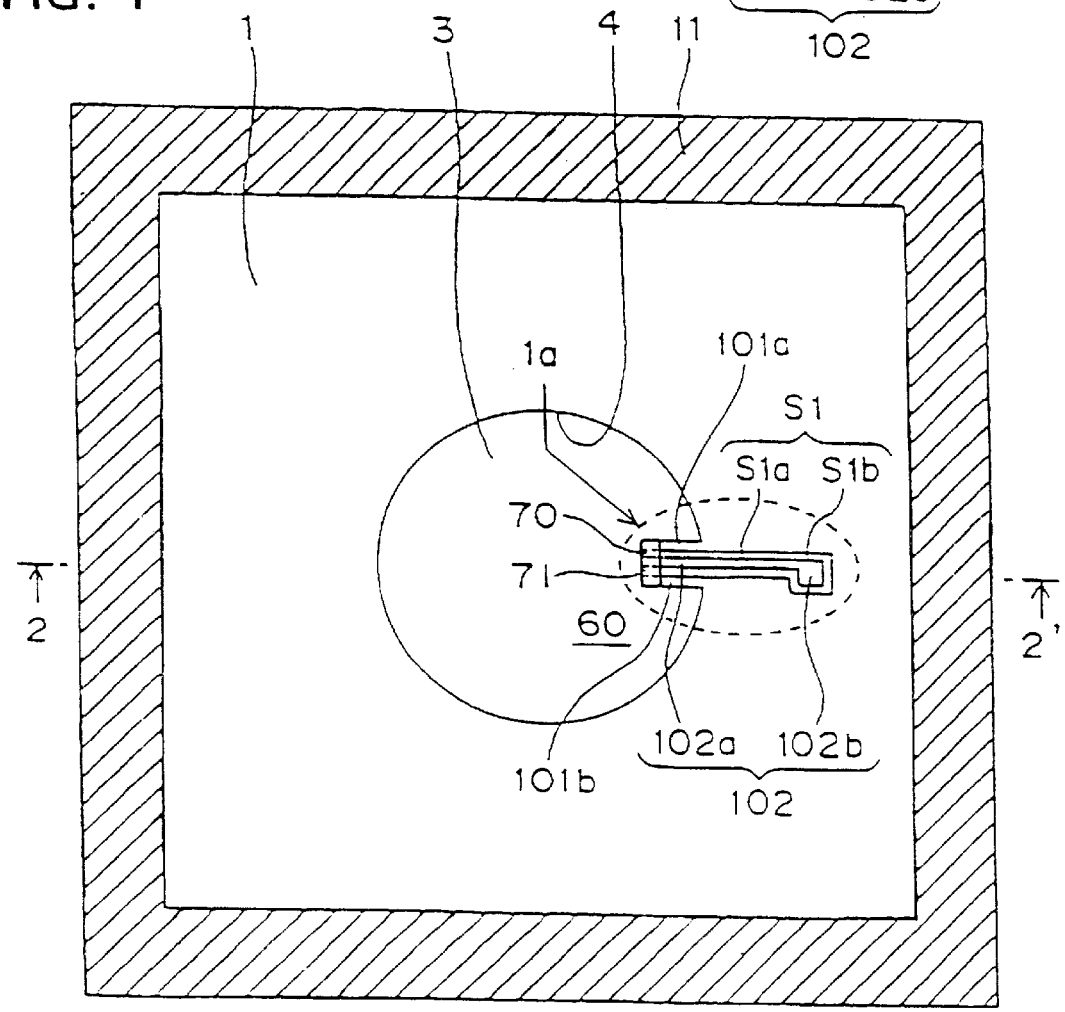
Figure 2:
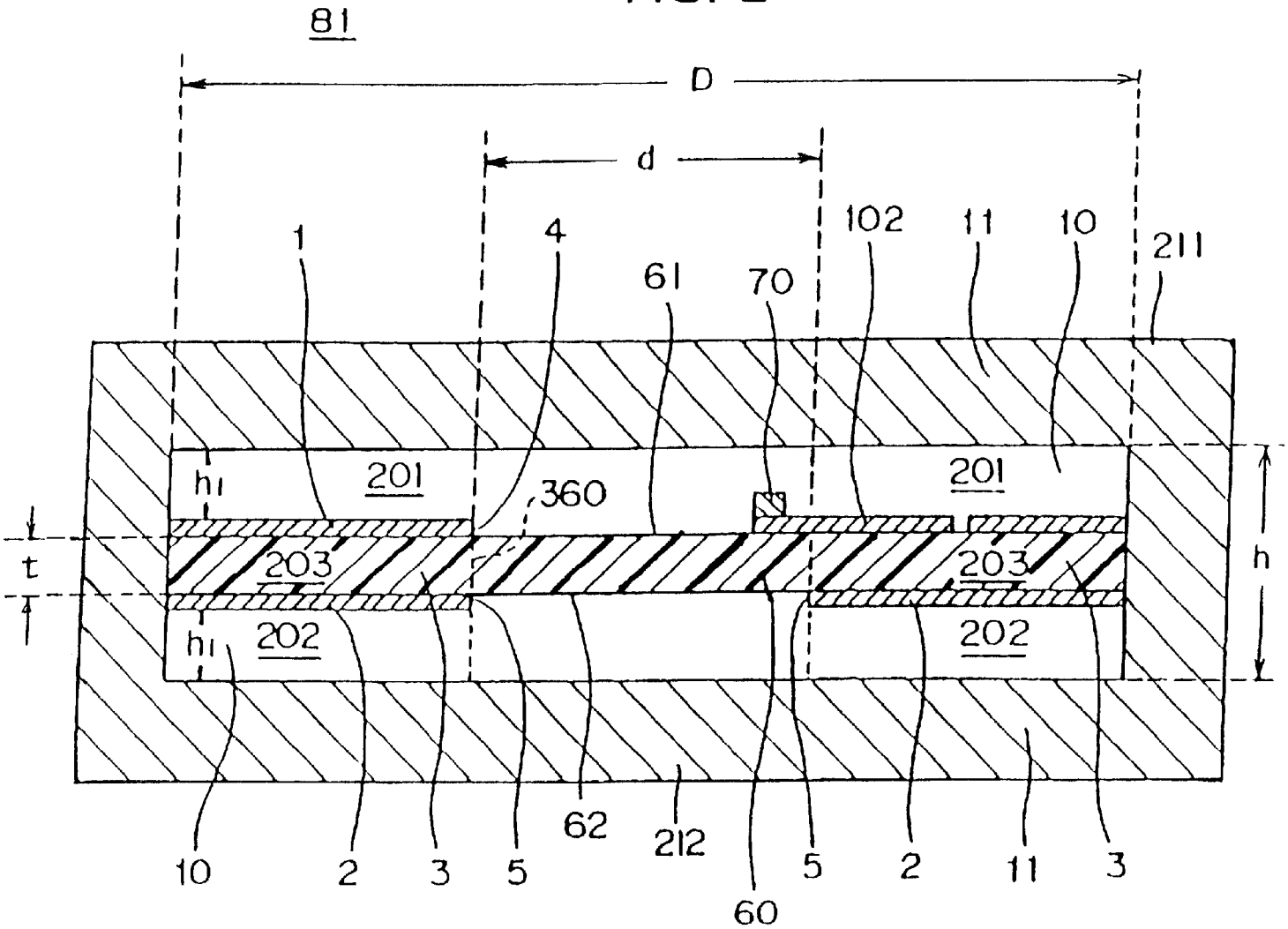
FIG. 2 is a longitudinal sectional view taken along the line A-A' of FIG. 1.

FIGS. 1 and 2 are a cross-sectional view and a longitudinal sectional view, respectively, of a variable frequency dielectric resonator 81 which represents a first embodiment of the present invention. FIG. 1 shows a section along a lateral plane between a varactor diode 70 and an upper conductor plate 211.

As shown in FIGS. 1 and 2, the variable frequency dielectric resonator 81 of the first embodiment has a resonator formation region 60 formed in a central portion of the dielectric substrate 3 provided between upper and lower conductor plates 211 and 212 opposed to each other. The resonator formation region 60 is defined between an opening 4 formed in a central portion of an electrode 1 and an opening 5 formed in a central portion of an electrode 2. The electrode 1 is formed on the upper surface of the dielectric substrate 3 while the electrode 2 is formed on the lower surface of the dielectric substrate 3.

A slit S1 is formed in the electrode 1 so as to connect with the opening 4. A bias electrode 102 is formed in the slit S1 so as to have an end projecting into the opening 4. Electrodes 101*a* and 101*b* are provided on the opposite sides of the bias electrode 102. Each of the electrode 101*a* and 101*b* is formed close to the bias electrodes 102 so as to have one end opposed to the end of the bias electrode 102 projecting into the opening 4 and to have the other end connected to the electrode 1.

A varactor diode 70 is connected between the corresponding opposed end of the electrode 101*a* and the end of the bias electrode 102 while a varactor diode 71 is connected between the end of the electrode 101*b* and the corresponding opposed end of the bias electrode 102. A predetermined direct current voltage is applied between the electrodes 101*a* and 101*b* and the bias electrode 102 to apply a reverse bias voltage between the two terminals of the varactor diodes 70 and 71. The resonance frequency of the dielectric resonator can be varied by changing the reverse bias voltage.

The variable frequency dielectric resonator 81 of the first embodiment will now be described in more detail with reference to the drawings.

As shown in FIGS. 1 and 2, the electrode 1 is formed on the upper surface of the dielectric substrate 3 provided between the upper and lower conductor plates 211 and 212 opposed to each other, and the circular opening 4 having a diameter d is formed over a central portion of the upper surface of the dielectric substrate 3. Also, the electrode 2 having the opening 5 having the same configuration as the opening 4 is formed on the lower surface of the dielectric substrate 3. The dielectric substrate 3 has a predetermined dielectric constant er and has a square shape each side of which has a length D. The diameter d of the openings 4 and 5 is smaller than the length of each side of the dielectric substrate 3, and the openings 4 and 5 are formed so as to be coaxial with each other.

A cylindrical resonator formation region 60 is defined in the dielectric substrate 3 with these openings. The resonator formation region 60 is a cylindrical region formed at the center of the dielectric substrate 3 and has an upper end surface 61 on the opening 4 side and a lower end surface 62 on the opening 5 side. The resonator formation region 60 also has a virtual circumferential surface 360 formed in the dielectric substrate 3.

The distance between the dielectric substrate 3 and the upper conductor plate 211, the distance between the dielectric substrate 3 and the lower conductor plate 212, the dielectric constant er and the thickness t of the dielectric substrate 3 and the diameter d of the openings 4 and 5 are set to such values that a standing wave occurs when a high-frequency signal having the same frequency as the resonance frequency of the variable frequency dielectric resonator 81 is input to the resonator formation region 60.

The electrode 1 is formed on the entire area of the upper surface of the dielectric substrate 3 except for the upper end surface 61 while the electrode 2 is formed on the entire area of the lower surface of the dielectric substrate 3 except for the lower end surface 62. An annular portion of the dielectric substrate 3 other than that in the resonator formation region 60 is interposed between the electrodes 1 and 2 to form a parallel-plate waveguide. The dielectric constant er and the thickness t of the dielectric substrate 3 are set to such values that a cut-off frequency of this parallel-plate waveguide in a TE01O mode which is a fundamental propagation mode of the parallel-plate waveguide is higher than the resonance frequency of the TE01O mode dielectric resonator 81. That is, the annular portion of the dielectric substrate 3 other than the resonator formation region 60, interposed between the electrodes 1 and 2, forms an attenuation region 203 for attenuating a high-frequency signal having the same frequency as the resonance frequency. In other words, the dielectric constant er and the thickness t of the dielectric substrate 3 are selected so that the attenuation region 203 attenuates a high-frequency signal having the same frequency as the resonance frequency.

The slit S1 is formed in the electrode 1 so as to connect with the opening 4. The slit S1 is formed of a strip electrode formation slit S1*a* which is defined by a predetermined length from its end open to the opening 4, which length is sufficiently larger than its width, and a terminal electrode formation slit S1*b* which is formed into a generally square shape and one side of which has a length larger than the width of the strip electrode formation slit S1*a*. The slit S1 is formed so that the lengthwise direction of the strip electrode formation slit S1*a* coincides with the direction normal to a circle defining the circumference of the opening 4.

The bias electrode 102 is formed by connecting a terminal electrode 102*b* having a generally square shape and provided for connection to a bias conductor wire (not shown) and a strip electrode 102*a* smaller in width than the terminal electrode 102*b* and having a length sufficiently larger than its width. The bias conductor wire has its one end connected to the terminal electrode 102*b* and the other end connected a variable voltage DC power source through a high-frequency coil or the like, for example. The bias electrode 102 is formed in the slit S1 while being insulated from the electrode 1. The bias electrode 102 is formed so that the terminal electrode 102*b* is positioned in the terminal electrode formation slit S1*b*, and so that the lengthwise direction of the strip electrode 102*a* is parallel to the lengthwise direction of the electrode formation slit S1*a*, with one end of the strip electrode 102*a* projecting in the opening 4.

The electrodes 101*a* and 101*b* are formed parallel to the strip electrode 102*a* on the opposite sides of the strip electrode 102*a* so that one end of each of the electrodes 101*a* and 101*b* is opposed to the projecting end of the strip electrode 102*a*, with the other end of each of the electrodes 101*a* and 101*b* connected to the electrode 1 in the vicinity of the position at which the slit S1 and the opening 4 meet each other. The varactor diode 70 is connected between the projecting ends of the electrode 101*b* and the strip electrode 102*a* while the varactor diode 71 is connected between the projecting ends of the electrode 101*b* and the strip electrode 102*a*. The cathode terminal of the varactor diode 70 is connected to the strip electrode 102*a* while the anode terminal of the varactor diode 70 is connected to the electrode 101*a*. Also, the cathode terminal of the varactor diode 71 is connected to the strip electrode 102*a* while the anode terminal of the varactor diode 71 is connected to the electrode 101*a*.

The dielectric substrate 3 with the electrodes 1 and 2 is provided in a cavity 10 formed in a conductor case 11, as described below. The conductor case 11 is formed by square upper and lower conductor plates 211 and 212 and four side conductors. Inside the conductor case 11, the cavity 10 is formed as a square prism having a height h and a square cross section each side of which has a length D. The dielectric substrate 3 is placed in the cavity 10 so that the side surfaces of the dielectric substrate 3 contact the side conductors of the conductor case 11, and so that the distance between the upper surface of the dielectric substrate 3 and the upper conductor plate 211 of the conductor case 11 and the distance between the lower surface of the dielectric substrate 3 and the lower conductor plate 212 of the conductor case 11 are equal to each other and approximately equal to a distance hi shown in FIG. 2, which is the distance between the surface of the electrode 1 or 2 and the upper or lower conductor plate 211 or 212. A free space formed between the electrode 1 and the portion of the upper conductor plate 211 other than the portion of the same facing the upper end surface 61 of the dielectric substrate 3 forms a parallel-plate waveguide. The distance h1 is set to such a value that a cut-off frequency of this parallel-plate waveguide in a TE01O mode which is a fundamental propagation mode of this parallel-plate waveguide is higher than the resonance frequency. That is, the free space between the electrode 1 and the portion of the upper conductor plate 211 other than the portion of the same facing the upper end surface 61 of the dielectric substrate 3 forms an attenuation region 201 for attenuating a high-frequency signal having the same frequency as the resonance frequency. In other words, the distance h1 is selected so that the attenuation region 201 attenuates a high-frequency signal having the same frequency as the resonance frequency.

Similarly, a free space formed between the electrode 2 and the portion of the lower conductor plate 212 other than the portion facing the lower end surface 62 of the dielectric substrate 3 forms a parallel-plate waveguide. The distance h1 between the electrode 2 on the dielectric substrate 3 and the lower conductor plate 212 of the conductor case 11 is set to such a value that a cut-off frequency of this parallel-plate waveguide in a $TE_{01O}$ mode which is a fundamental propagation mode of this parallel-plate waveguide is higher than the resonance frequency. That is, the free space between the electrode 2 and the portion of the lower conductor plate 212 other than the portion of the same facing the lower end surface 62 of the dielectric substrate 3 forms an attenuation region 202 for attenuating a high-frequency signal having the same frequency as the resonance frequency. In other words, the distance h1 is selected so that the attenuation region 202 attenuates a high-frequency signal having the same frequency as the resonance frequency. The variable frequency dielectric resonator 81 of the first embodiment is thus constructed.

The operation of the variable frequency dielectric resonator 81 of the first embodiment constructed as described above will now be described. The principle of resonance in the variable frequency dielectric resonator 81 can be explained in the same manner as the principle of resonance in a TE01O mode dielectric resonator 81*a* which is constructed by removing the slit S1, the bias electrode 102, the electrodes 101*a* and 101*b* and the varactor diodes 70 and 71 from the variable frequency dielectric resonator 81. Therefore, the principle of resonance in the $TE_{01O}$ mode dielectric resonator 81*a* will first be described with reference to FIGS. 3 to 9 and the principle of changing the resonance frequency of the variable frequency dielectric resonator 81 will next be described.

Figure 3:
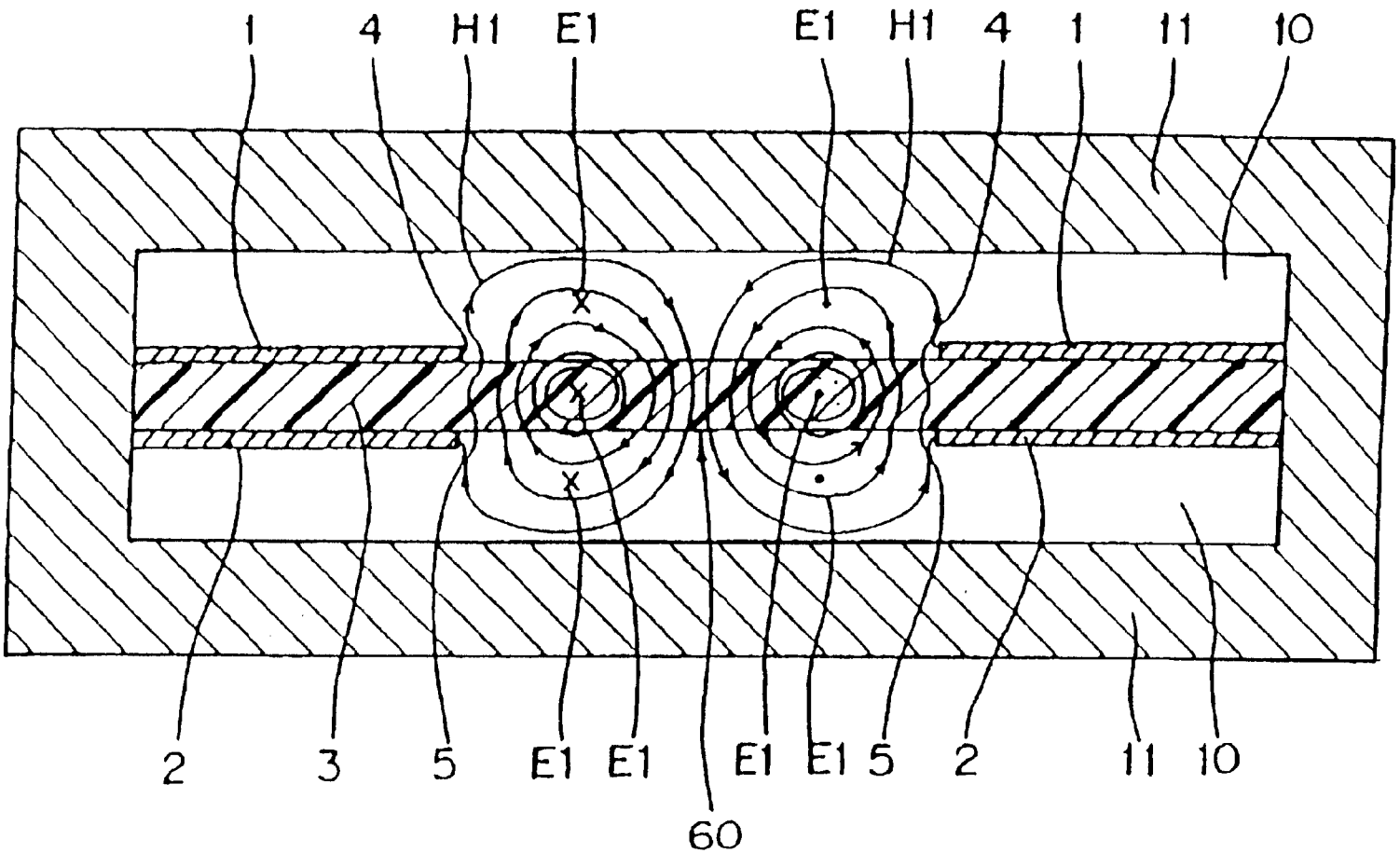
FIG. 3 is a longitudinal sectional view of a TE01O mode dielectric resonator 81*a* for explanation of the principle of resonance in the variable frequency resonator 81 shown in FIG. 1.

In the $TE_{01O}$ mode dielectric resonator 81*a* shown in FIG. 3, a resonator formation region 60 in which a standing wave occurs when a high-frequency signal having the same frequency as the resonance frequency is input is formed at the center of a dielectric substrate 3, as in the case of the variable frequency dielectric resonator 81 shown in FIG. 1, while attenuation regions 201, 202, and 203 which attenuate a high-frequency signal having the same frequency as the resonance frequency are formed. When the $TE_{01O}$ mode dielectric resonator 81*a* is excited by a high-frequency signal having the same frequency as the resonance frequency, the $TE_{01O}$ mode dielectric resonator 81*a* has an electromagnetic field confined in the resonator formation region 60 and in free spaces in the vicinity of the resonator formation region 60 to resonate, as shown in FIG. 3.

Figure 4:
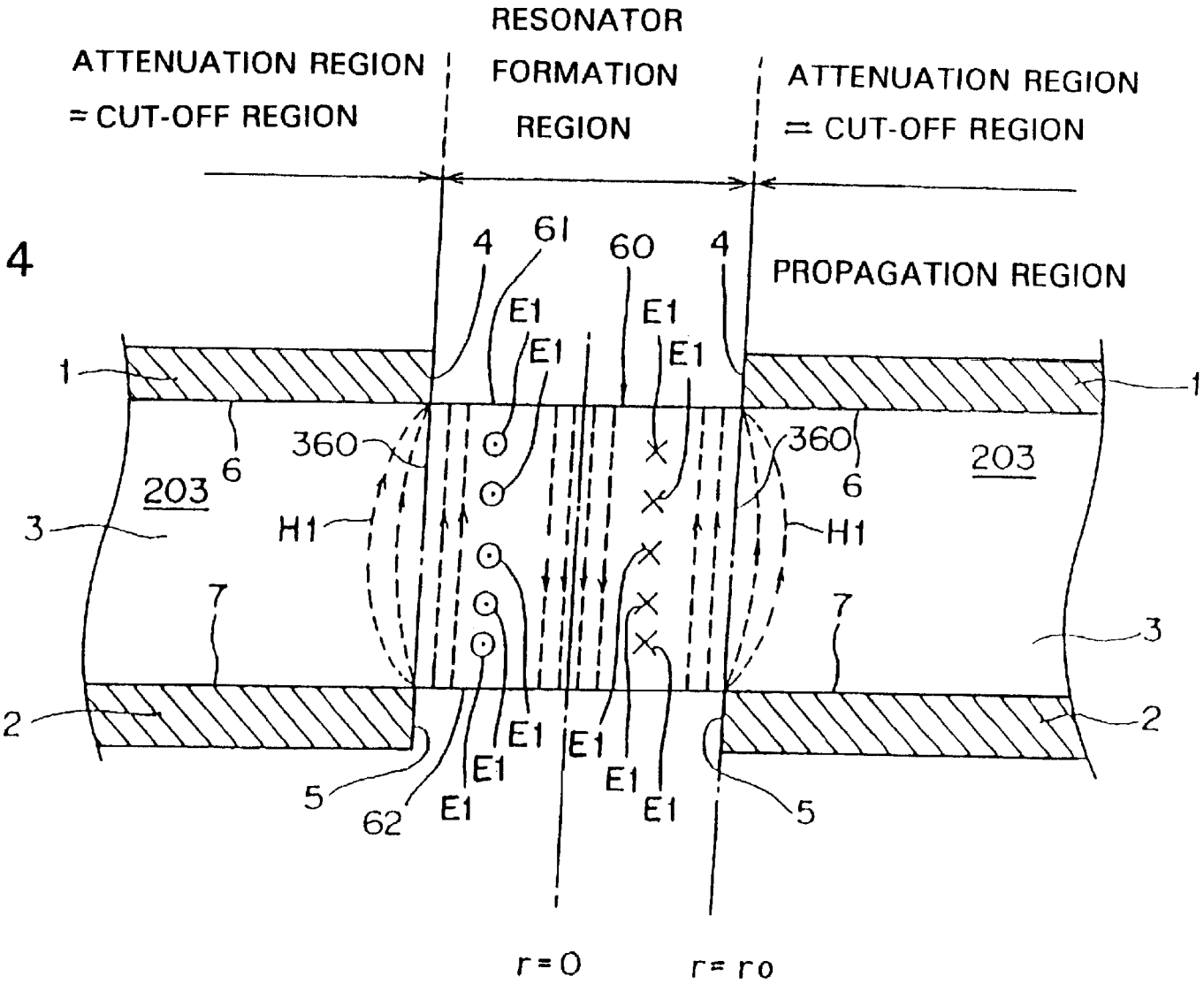
FIG. 4 is a longitudinal sectional view of a dielectric substrate 3 for explanation of the principle of resonance in the $TE_{01O}$ mode dielectric resonator 81*a* shown in FIG. 3.

The principle of the operation of the $TE_{01O}$ mode dielectric resonator 81*a* will now be described in more detail. FIG. 4 is a cross-sectional view of a central portion of the dielectric substrate 3 for explaining the principle of the operation of the $TE_{01O}$ mode dielectric resonator 81*a*. In FIG. 4, the upper end surface 61 and the lower end surface 62 are shown, each being assumed to be an approximation of a magnetic wall. In the resonator formation region 60 between these surfaces, a $TE_{00}^{-}$ mode of a cylindrical wave having propagation vectors only in directions toward the axis of the resonator formation region 60 or a $TE_{00}^{+}$ mode of a cylindrical wave having propagation vectors only in directions away from the axis of the resonator formation region 60 toward a circumferential surface 360 exists as a propagation mode. The symbols (+) and (−) attached to TE as superscripts respectively denote a cylindrical wave having propagation vectors only in directions toward the axis of the resonator formation region 60 and a cylindrical wave having propagation vectors only in directions away from the axis of the resonator formation region 60 toward the circumferential surface 360. The lower surface 6 of the electrode 1 adjacent to the upper surface of the dielectric substrate 3 and the upper surface 7 of the electrode 2 adjacent to the lower surface of the dielectric substrate 3 function as electric walls. Incidentally, a cylindrical wave is an electromagnetic wave which can be expressed by a cylindrical function such as a Bessel Function or a Hankel function. In the following description, a cylindrical coordinate system is used in which the z-axis is set along the axis of the resonator formation region 60, the distance in a radial direction away from the axis of the resonator formation region 60 is represented by r, and the angle in the circumferential direction of the resonator formation region 60 is represented by f.

Under the above-described boundary conditions, an electromagnetic field distribution in a $TE_{0mO}$ mode can be expressed by equations (1) and (2) by using the cylindrical coordinate system. In the equations (1) and (2), Hz represents a magnetic field in the axial direction of the resonator formation region 60, i.e., the direction of z-axis, and Ef represents an electric field in the f-direction. Also, $k_0$ is a wavelength constant, w is the angular frequency, and m is the permeability of the dielectric substrate 3.

$$H_z=k_0^2U \tag{1}$$

$$E_f=jwm\ (\P U/\P r) \tag{2}$$

In these equations, U is an electromagnetic field scalar potential, which is ordinarily expressed by superposition of a cylindrical wave having propagation vectors only in directions toward the axis of the resonator formation region 60 and a cylindrical wave having propagation vectors only in directions from the axis of the resonator formation region 60 toward the circumferential surface 360. That is, it can be expressed by the following equation (3) using constants $c_1$ and $c_2$, $H_0^{(1)}(k_r r)$ which is a 0-order first Hankel function and $H_0^{(2)}(k_r r)$ which is a 0-order second Hankel function:

$$U=c_1H_0^{(1)}(k_r r)+c_2H_0^{(2)}(k_r r) \tag{3}$$

where kr is an eigenvalue determined by the boundary condition in the direction of radius vectors. It is necessary to satisfy a perfect standing wave condition: $c_1=c_2$ in order that both the magnetic field Hz and the electric field Ef be finite on the axis of the resonator formation region at which r=0. From this condition and relational expressions (4) and (5), the electromagnetic field scalar potential U can be expressed by equation (6) using $J_0(k_r r)$ which is a 0-order first Bessel function.

$$H_0^{(1)}(k_r r)=J_0(k_r r)+jY_0(k_r r) \tag{4}$$

$$H_0^{(2)}(k_r r)=J_0(k_r r)-jY_0(k_r r) \quad (5)$$

$$U=AJ_0(k_r r) \quad (6)$$

where $A=c_1+c_2$.

From equations (1), (2) and (6), the magnetic field Hz and the electric field Ef can be respectively expressed by the following equations (7) and (8):

$$H_z=Ak_0^2J_0(k_r r) \quad (7)$$

$$E_f=jwmk_rAJ_1(k_r r) \quad (8)$$

It is necessary to set $k_r$ to such a value as to satisfy the following equation (9) in order that the electric field Ef be substantially zero at the virtual circumferential surface 360 of the resonator formation region 60 at which $r=r_0=d/2$.

$$k_r r_0=3.832 \quad (9)$$

The magnetic field Hz and the electric field Ef in the resonating state in the $TE_{01O}$ mode can be obtained by substituting in equations (7) and (8) the value of kr satisfying this equation (9).

Figure 5:
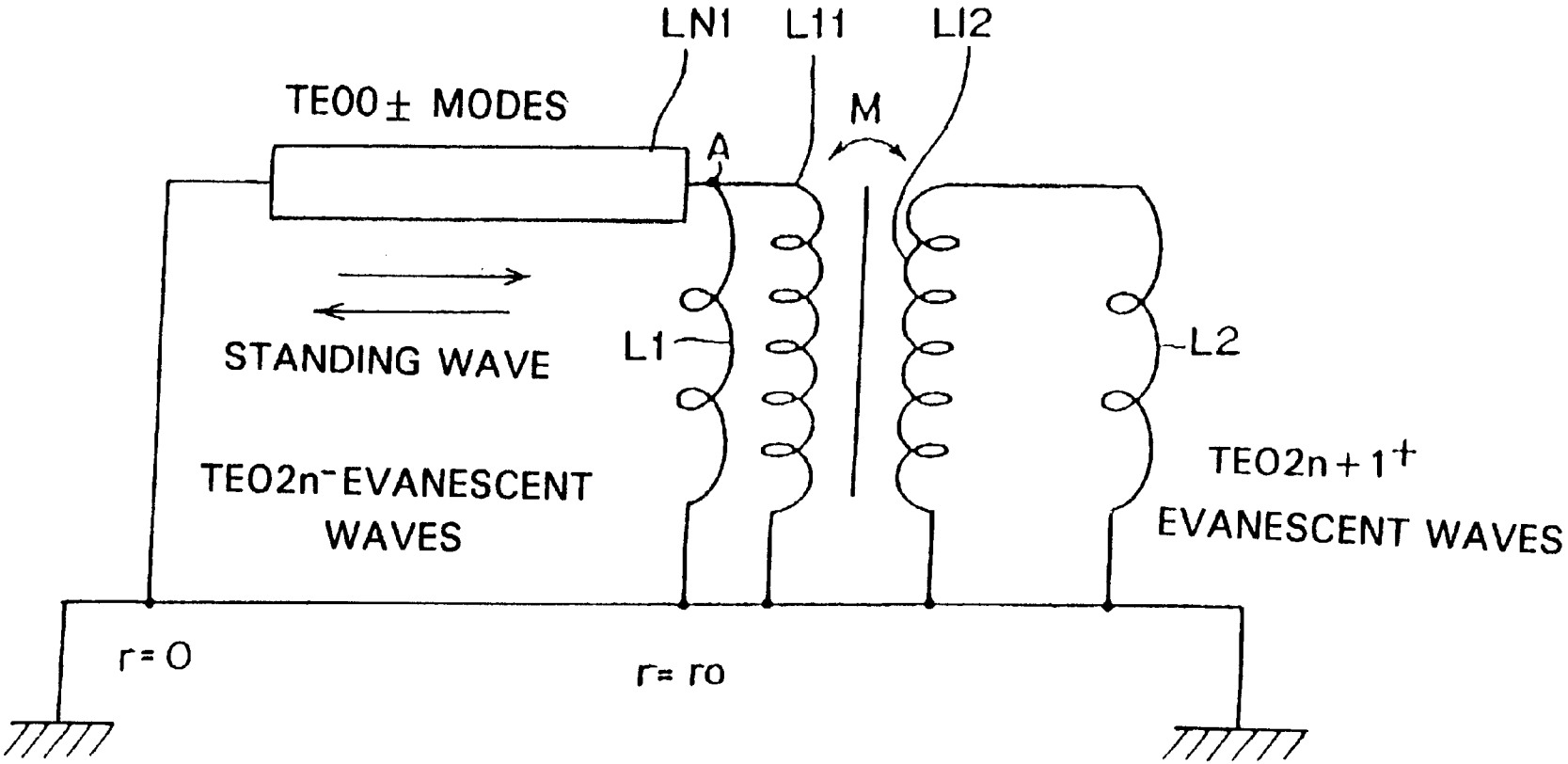
FIG. 5 is a circuit diagram showing an equivalent circuit of the $TE_{01O}$ mode dielectric resonator 81*a* shown in FIG. 3.

Thus, the magnetic field Hz and the electric field Ef have been obtained under the condition that Ef=0 is satisfied when $r=r_0$, that is, the electric field Ef is zero at the virtual circumferential surface 360 of the resonator formation region 60. Actually, however, $TE_{0n}^{\pm}$ modes, which are high-order modes, occur in the vicinity of the end surfaces of the electrodes 1 and 2 at the circumferences of the openings 4 and 5, and the magnetic field Hz and the electric field $E_f$ couple with electromagnetic fields of $TE_{0n}^{\pm}$ modes, so that distortions occur in the magnetic field Hz and the electric field Ef. In $TE_{0n}^{\pm}$, n represents even numbers. This condition can be expressed in an equivalent circuit such as that shown in FIG. 5. In FIG. 5, a transmission line LN1 represents paths of propagation in $TE_{0n}^{\pm}$ modes in the resonator formation region 60 in the direction toward the axis of the resonator formation region 60 and in the direction from the axis of the resonator formation region 60 toward the circumferential surface 360. If there is no electric field component at the circumferential surface 360 at which $r=r_0$, that is, if the circuit as seen rightward from a point A is electrically short-circuited, resonance occurs only in the TE01O mode of the fundamental wave to satisfy equation (9).

In the case of the present model, however, the boundary conditions are discontinuous at r=r0, so that the cylindrical wave couples with evanescent waves in $TE_{0'2n}^{-}$ modes with respect to $n^3$ 1 in the resonator formation region 60, and couples with evanescent waves in $TE_{0'2n+1}^{+}$ modes with respect to $n^3$ 0 in the attenuation region 203 between the electric walls. Accordingly, in the equivalent circuit of FIG. 5, an inductor L1 represents magnetic energy of evanescent waves in $TE_{0'2n}^{-}$ modes while an inductor L2 represents magnetic energy of evanescent waves in $TE_{0'2n+1}^{+}$ modes. Also, inductors L11 and L12 represent magnetic energy of the corresponding regions and couple with each other by inductive coupling.

As can be understood from this equivalent circuit, the perfect standing wave condition of the $TE_{00}^{\pm}$ modes can always be satisfied although the resonance frequency of the $TE_{01O}$ mode dielectric resonator 81*a* varies depending upon the reactance determined by the inductors L1 and L12 connected to the point A.

In this model, the upper and lower surfaces of the propagation region, i.e., the upper end surface 61 and the lower end surface 62 of the resonator formation region 60, are assumed to be magnetic walls. In an actual model, however, the resonance frequency becomes higher by several tens of percent by the effect of magnetic perturbation of the upper and lower conductor plates of the conductor case 11 in comparison with the case where there is no magnetic perturbation.

The result of electromagnetic field analysis made with respect to the TE01O mode dielectric resonator 81*a* will next be described. Methods have been reported which are ordinarily used to analyze the electromagnetic field of TE mode dielectric resonators based on a variation method or a mode matching method. In the $TE_{01O}$ mode dielectric resonator 81*a*, however, high-order $TE_{0n}$ modes (n: even number) occur at the inner surfaces of the electrodes 1 and 2 forming the circumferential ends of the openings 4 and 5, as described above. Therefore, it is difficult to use a variation method or a mode matching method for electromagnetic field analysis in the vicinity of the inner circumferential surfaces of the electrodes 1 and 2. For this reason, a finite element method was used for electromagnetic field analysis of the $TE_{01O}$ mode dielectric resonator 81*a*. Electromagnetic field analysis was made by using a two-dimensional finite element method suitable for electromagnetic field analysis of a device having a rotation symmetry structure in order to increase the calculation speed and calculation accuracy. This finite element method treats as unknown parameters the values of tangential components at an elemental boundary segment of the redirection and z-direction components of the electric field expressed in the cylindrical coordinate system and the value of the f-direction component at the elemental boundary segment of the electric field. This method is advantageous in that any spurious solution cannot easily be calculated and that the problem of an error due to singularity of the electric field in the vicinity of the center axis can be avoided.

Figure 6A:
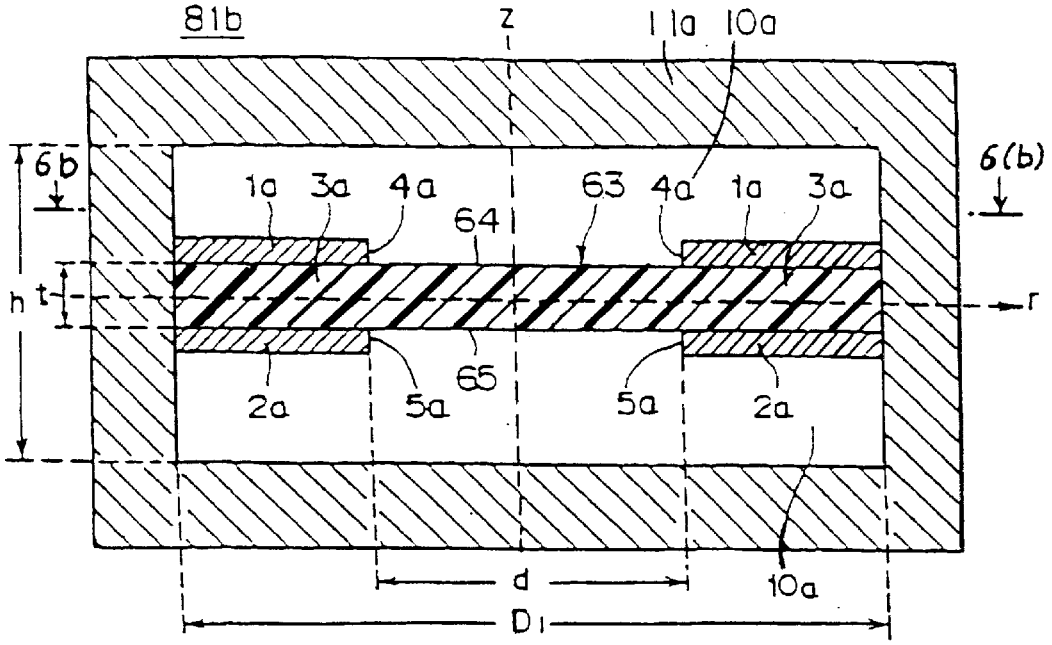
FIG. 6(*a*) is a longitudinal sectional view of a $TE_{01O}$ mode dielectric resonator 81*b* which was used as a model for analyzing the operation of the $TE_{01O}$ mode dielectric resonator 81*a* shown in FIG. 3.
Figure 6B:
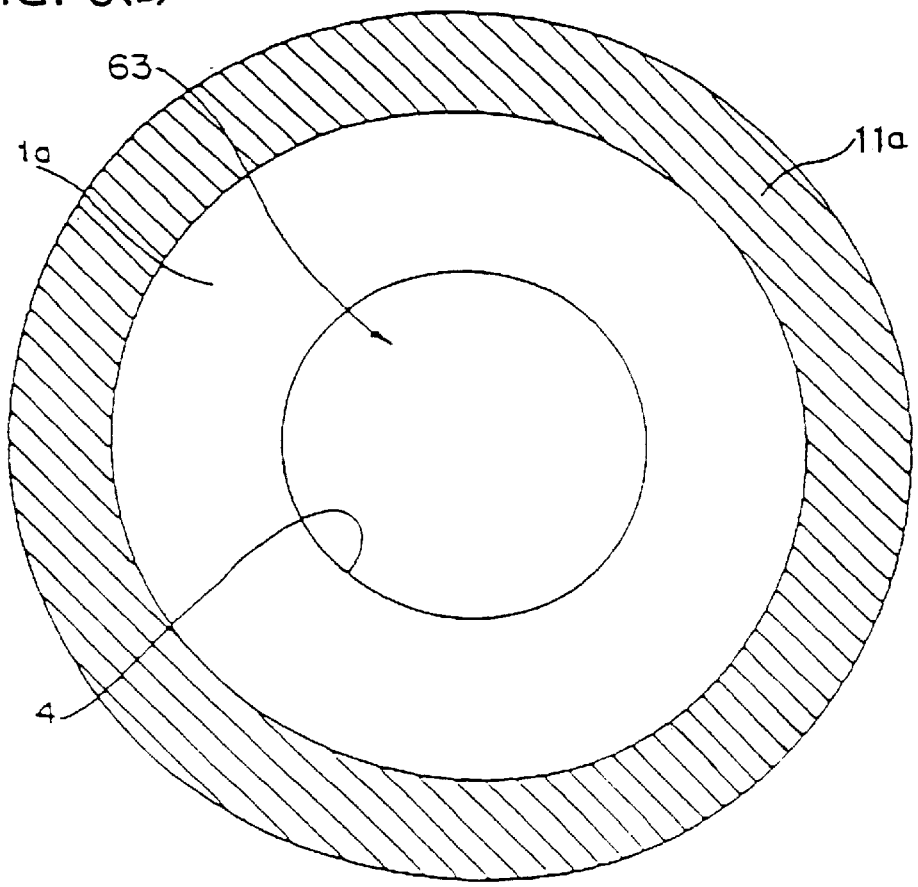

FIG. 6(*a*) is a longitudinal sectional view of a TE01O mode dielectric resonator 81*b* which was used as a model for analyzing the electromagnetic field of the TE01O mode dielectric resonator 81*a*. FIG. 6(*b*) is a cross-sectional view taken along the line B-B' of FIG. 6(*a*). The TE01O mode dielectric resonator 81*b* differs from the TE01O mode dielectric resonator 81*a* in that a circular dielectric substrate 3*a* is used in place of the square dielectric substrate 3, and that a conductor case 11*a* having a circular cross-sectional shape is used in place of the conductor case 11 having a square cross-sectional shape. An electrode 1*a* having an opening 4*a* and an electrode 2*a* having an opening 5*a* are respectively formed on the upper and lower surfaces of the dielectric substrate 3*a* to form a resonator formation region 63, as are the corresponding electrodes in the $TE_{01O}$ mode dielectric resonator 81*a*. Also, the dielectric substrate 3*a* is provided in a cavity 10*a* formed in the conductor case 11*a*, as is the dielectric substrate 3 in the $TE_{01O}$ mode dielectric resonator 81*a*. The dielectric substrate 3*a*, the openings 4*a* and 5*a* and the cylindrical cavity 10*a* are disposed so as to be coaxial with each other. The above-described two-dimensional finite element method can be used with respect to the thus-constructed $TE_{01O}$ mode dielectric resonator 81*b*. If the diameter D1 of the cavity 10*a* is set to a predetermined value larger than the diameter d of the resonator formation region 63, the resonator formation region 60 of the $TE_{01O}$ mode dielectric resonator 81*a* and the resonator formation region 63 of the $TE_{01O}$ mode dielectric resonator 81*b* have equal electromagnetic field distributions. Thus, the $TE_{01O}$ mode dielectric resonator 81*b* can be used as a model for electromagnetic field analysis of the $TE_{01O}$ mode dielectric resonator 81*a*.

Referring to FIG. 6(*a*), the z-axis, which is an axis of rotation symmetry, was set so as to coincide with the axis of the resonator formation region 63, and a plane of z=0 was assumed to be a magnetic wall. A center point of the axis of the resonator formation region 63 was assumed to correspond to z=0 of the z-axis. Structural parameters were set as shown below and the relationship between the resonance frequency of the $TE_{01O}$ mode dielectric resonator 81*b* and the diameter d of the upper end surface 64 of the resonator formation region 63 was calculated with respect to different values of the thickness t of the dielectric substrate 3*a*, i.e., 0.2 mm, 0.33 mm, and 0.5 mm to obtain the result shown in the graph of FIG. 7.

(1) (Dielectric constant $e_r$ of dielectric substrate 3*a*)=9.3

(2) (Height h of cavity 10*a*)=2.25 mm

Figure 7:
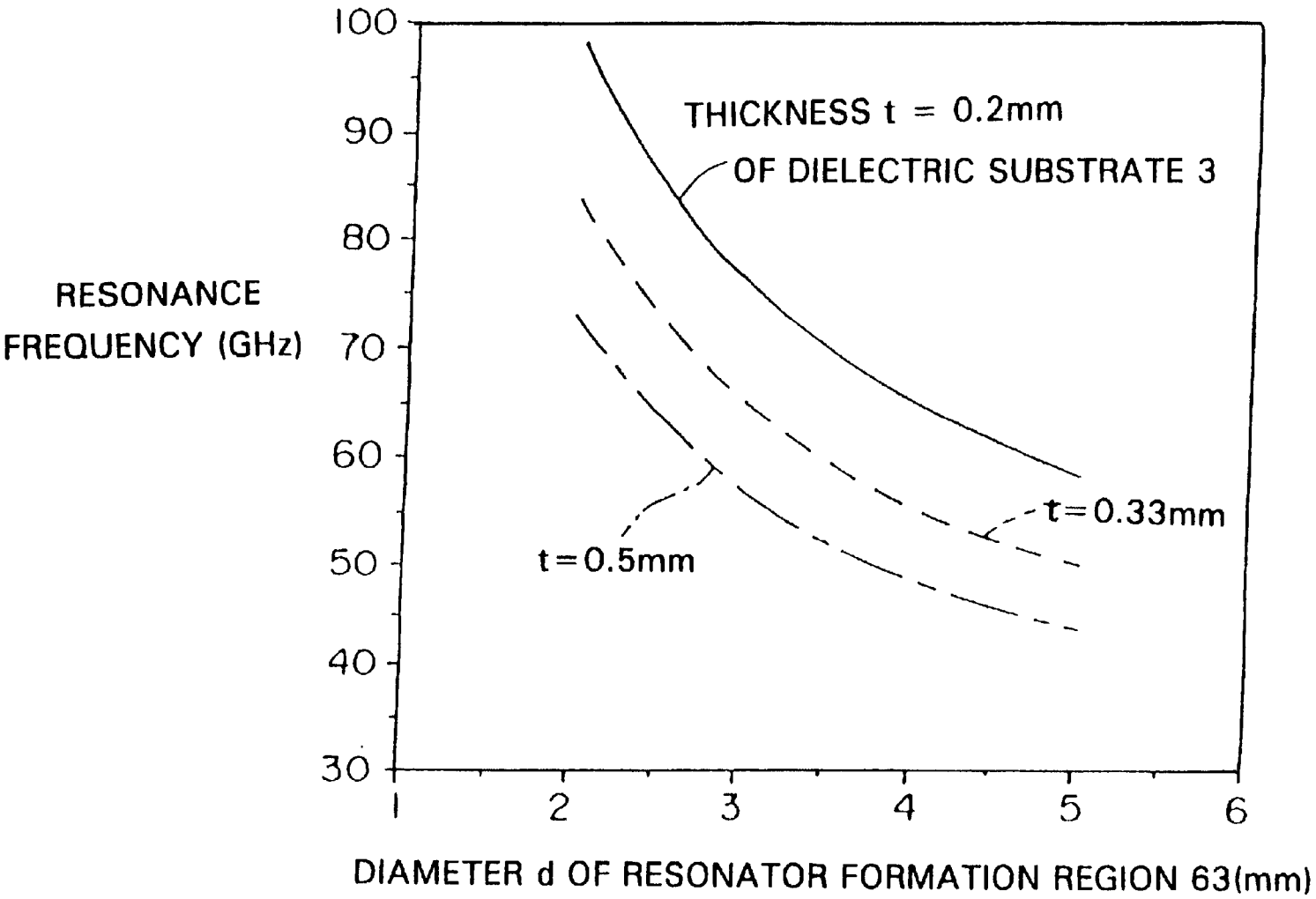
FIG. 7 is a graph showing the relationship between the resonance frequency and the diameter d of a resonator formation region 63 in the $TE_{01O}$ mode dielectric resonator 81*a* shown in FIG. 3.

It can be clearly understood from FIG. 7 that the $TE_{01O}$ mode dielectric resonator 81*b* resonates in the millimeter wave band from 40 to 100 GHz if the structural parameters are set as described above. It can also be understood that the resonance frequency becomes lower if the thickness t of the dielectric substrate 3*a* is increased while the diameter d of the upper end surface 64 of the resonator formation region 63 is fixed, and that the resonance frequency becomes lower if the diameter d of the upper end surface 64 of the resonator formation region 63 is increased while the thickness t of the dielectric substrate 3*a* is fixed.

Figure 8:
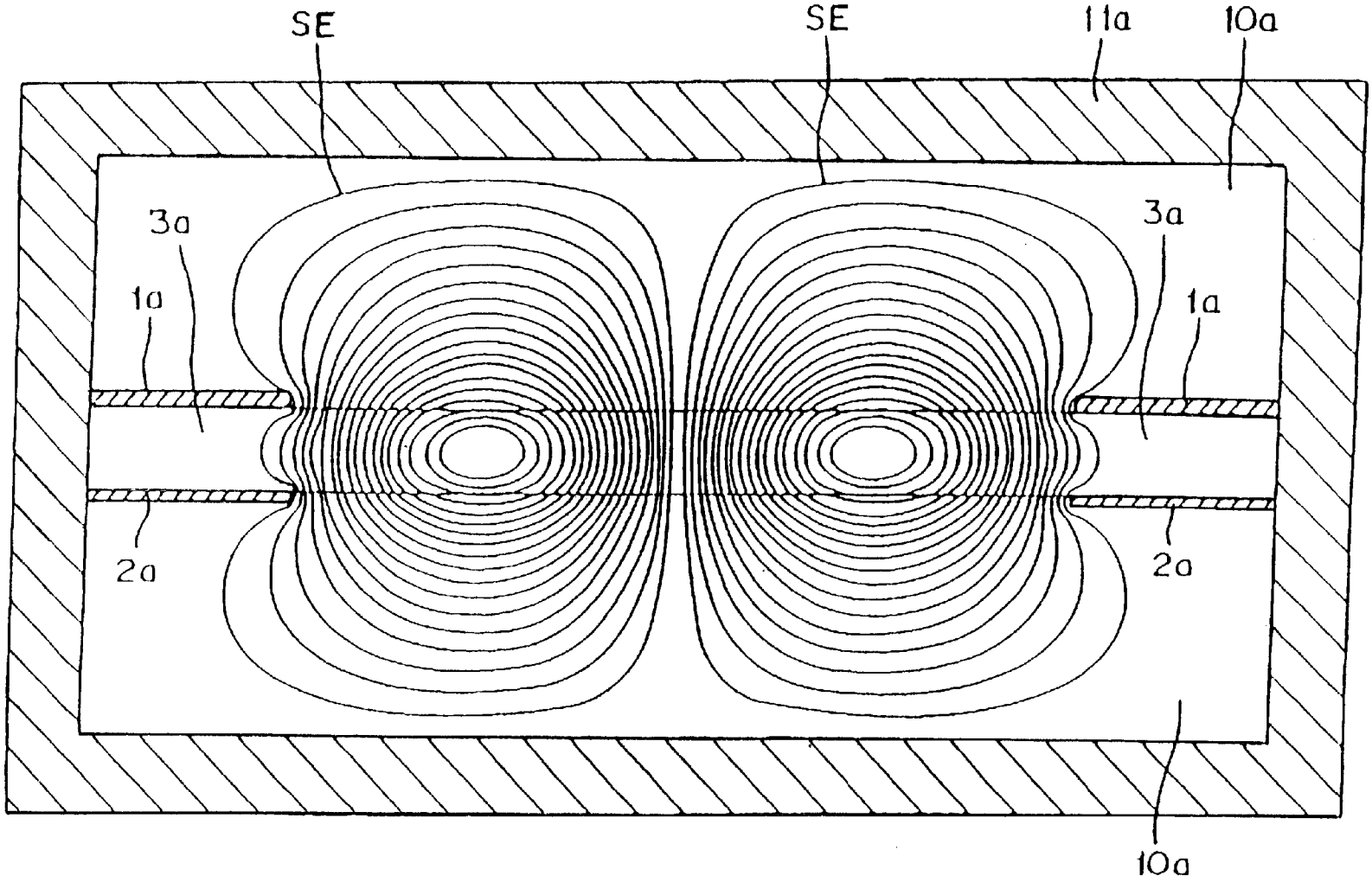
FIG. 8 is a longitudinal sectional view of an electric field strength distribution in the longitudinal sectional view of FIG. 6(*a*)
Figure 9:
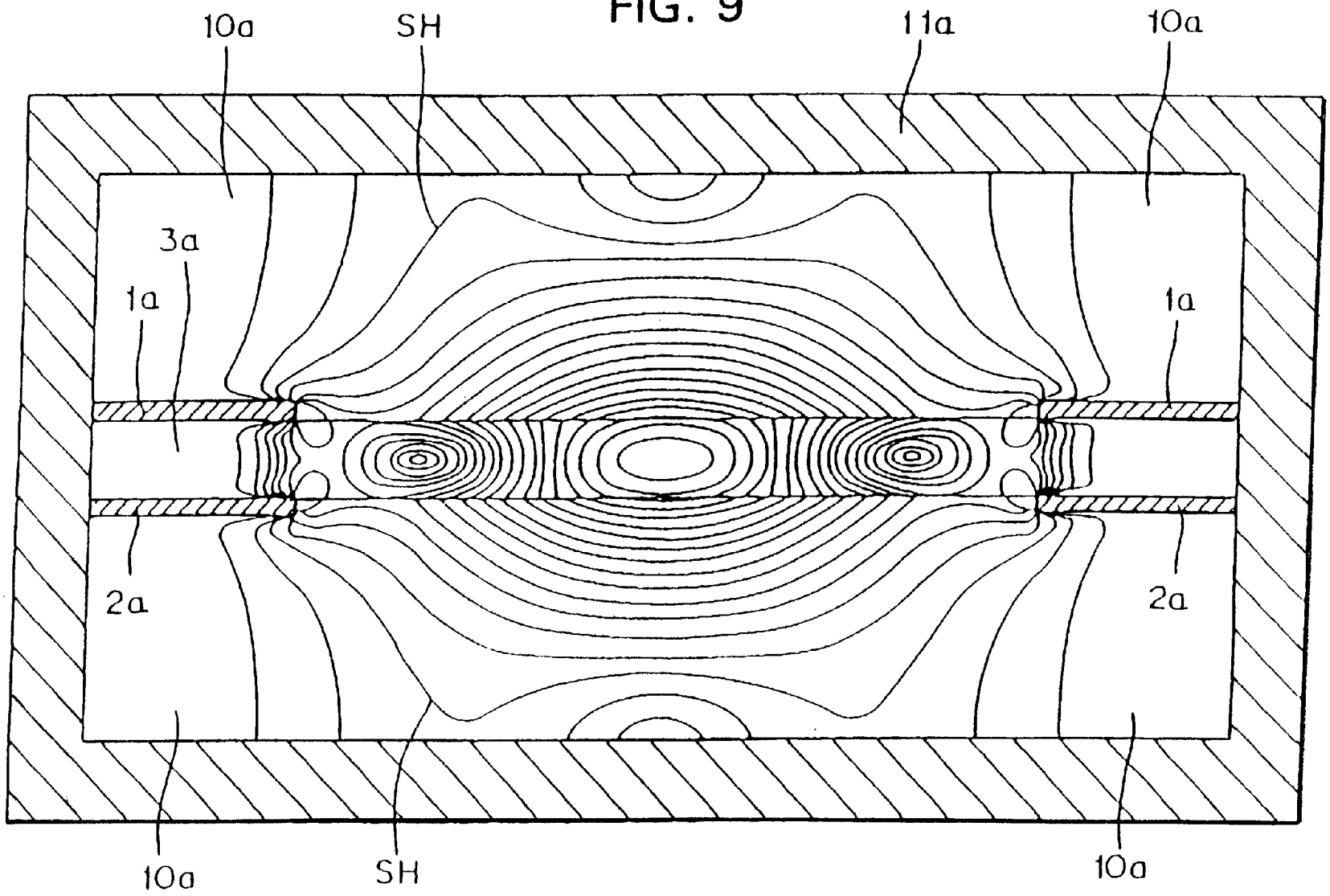
FIG. 9 is a longitudinal sectional view of a magnetic field strength distribution in the longitudinal sectional view of FIG. 6(*a*)

FIG. 8 shows a distribution of the strength of the electric field Ef when the structural parameters were set as described above. In FIG. 8, contour lines SE represent the distribution. Also, FIG. 9 shows a distribution of the strength of the magnetic field Hz represented by contour lines SH. As can be clearly understood from FIG. 8, the strength of the electric field is distributed in a toric form in the f-direction. As can be clearly understood from FIG. 9, the z-component of the magnetic field is distributed so as to be maximized at the center of the resonator. These distributions are very close to those in the electromagnetic distribution of the conventional $TE_{01d}$ mode dielectric resonator. However, it can be understood that electric energy and magnetic energy are concentrated more strongly inside the resonator formation region 63 because the regions outside the resonator formation region 63 have a cut-off effect much higher than that in the conventional $TE_{01d}$ mode dielectric resonator. Therefore, the mutual action between circuit elements can be reduced and a circuit configuration having a higher integration density can therefore be expected.

As described above in detail, the $TE_{01O}$ mode dielectric resonator 81*a* can be caused to resonate at a desired resonance frequency by setting the diameter d and so on to predetermined values. A resonance current which is a high-frequency current flows on an edge portion of the electrode 1 in the vicinity of the resonator formation region 60 in the $TE_{01O}$ mode dielectric resonator 81*a*. The variable frequency dielectric resonator 81 of the first embodiment has, in the construction of the TE01O mode dielectric resonator 81*a*, the varactor diodes 70 and 71 connected between the electrodes 101*a* and 101*b* connected to the edge portions of the electrode 1 on which the high-frequency current flows, and the bias electrode 102 formed in the slit S1.

Figure 12:
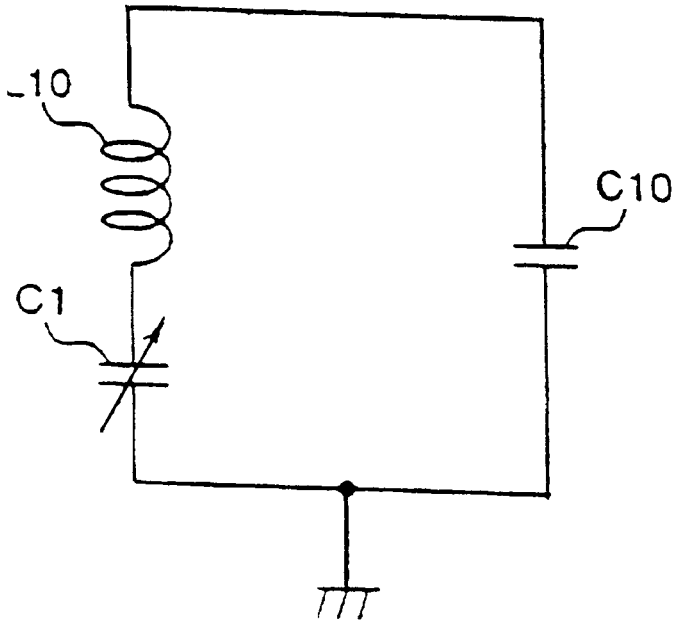
FIG. 12 is a circuit diagram showing an equivalent circuit of the variable frequency dielectric resonator 81 shown in FIG. 1.
Figure 13:
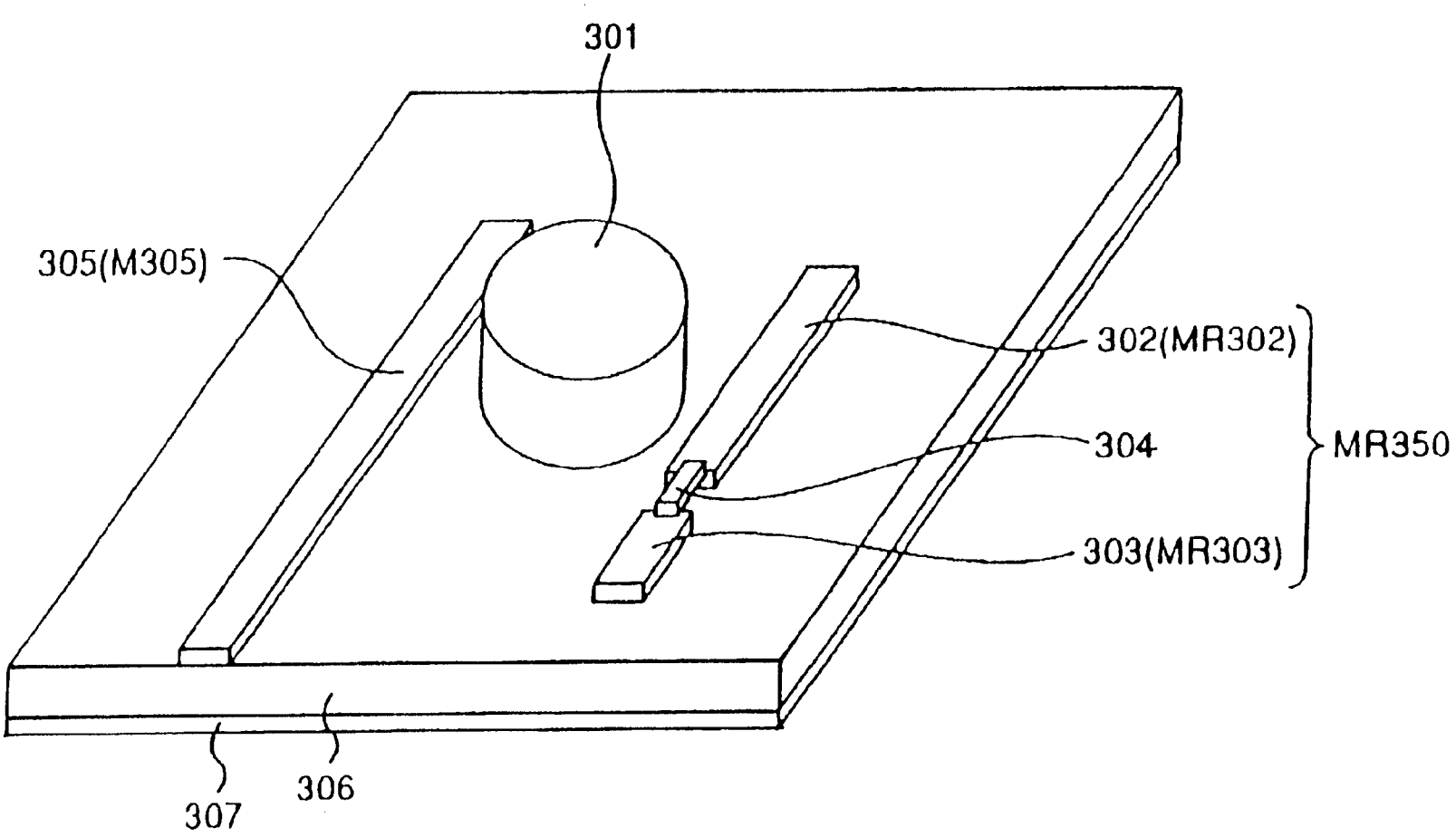
FIG. 13 PRIOR ART
FIG. 13 is a perspective view of a conventional variable frequency dielectric resonator.

From the above, an equivalent circuit of the variable frequency dielectric resonator 81 shown in FIG. 12 can be formed in which a capacitance C10 and an inductor L10 corresponding to the $TE_{01O}$ mode dielectric resonator 81*a* and a variable capacitor C1 corresponding to the series connection capacitance of the varactor diodes 70 and 71 are connected in series.

Accordingly, the equivalent electrostatic capacity of the variable frequency dielectric resonator 81 expressed by the series connection of the capacitor C10 and the variable capacitor C1 is variable by changing the electrostatic capacity of the varactor diodes 70 and 71. The electrostatic capacity of the varactor diodes 70 and 71 is changed by changing the bias voltage applied between the electrode 101 and the bias electrode 102 formed in the slit S1. The resonance frequency of the variable frequency dielectric resonator 81 is variable by changing the equivalent electrostatic capacity in this manner. If the equivalent electrostatic capacity of the variable frequency dielectric resonator 81 is increased, the resonance frequency of the variable frequency dielectric resonator 81 becomes lower. If the equivalent electrostatic capacity of the variable frequency dielectric resonator 81 is reduced, the resonance frequency of the variable frequency dielectric resonator 81 becomes higher.

The variable frequency dielectric resonator 81 constructed as described above is a single-mode resonator arranged by using one $TE_{01O}$ mode dielectric resonator 81*a* so that the resonance frequency of the $TE_{01O}$ mode dielectric resonator 81*a* can be directly changed. Therefore, if the variable frequency dielectric resonator 81 is applied to an oscillator, occurrence of a mode jump, i.e., a change to a resonance mode other than the TE01O mode causing oscillation at a frequency other than the resonance frequency in the $TE_{01O}$ mode, can be reduced.

When the variable frequency dielectric resonator 81 is manufactured, the slit S1 and the bias electrode 102 can be formed simultaneously with the electrode 1, so that the variable frequency dielectric resonator 81 can be manufactured at a comparatively low cost.

The variable frequency dielectric resonator 81, an oscillation circuit, an amplifier circuit and the like can be formed on one dielectric substrate in such a manner that the resonator formation region 60, the slit S1 and the varactor diodes and so on are provided in and on a part of one dielectric substrate while a negative resistance circuit, an amplifier circuit and the like are provided on another part of the dielectric substrate. In this manner, a microwave circuit including the variable frequency dielectric resonator 81 can easily be manufactured at a low cost.

The variable frequency dielectric resonator 81 can easily be coupled with a nonradiative dielectric waveguide (NRD guide) and can therefore be coupled with an external circuit in a simple manner.

The variable frequency dielectric resonator 81 of the first embodiment is formed so as to have the electrodes 101*a* and 101*b* and the strip electrode 102*a* one end of which projects into the opening 4. Also, as shown in FIG. 8, the electric field becomes stronger at a position closer to the center of the opening 4. That is, the electrodes 101*a* and 101*b* and the strip electrode 102*a* are formed so as to project to a position in the opening 4 at which the electric field is strong, so that the electrodes 101*a* and 101*b* and the strip electrode 102*a* can be strongly coupled with the electric field at the time of resonance. Consequently, the amount of change in resonance frequency can be increased in comparison with the case where the varactor diodes 70 and 71 are connected in the vicinity of the position at which the slit S1 and the opening 4 meet each other.

Also in the variable frequency dielectric resonator 81 of the first embodiment, the cathode terminals of the varactor diodes 70 and 71 are connected to the strip electrode 102*a* while the anode terminals of the varactor diodes 70 and 71 are respectively connected to the electrodes 101*a* and 101*b*. In this manner, the capacitance of the varactor diode 70 and the capacitance of the varactor diode 71 are connected in parallel with each other between the electrode 1 and the bias electrode 102. Accordingly, the total capacitance of this parallel connection is the sum of the two capacitances. Therefore, the total capacitance can be changed by a large amount by a small change in the reverse bias voltage, so that the resonance frequency can also be changed by a large amount.

Second Embodiment

Figure 10:
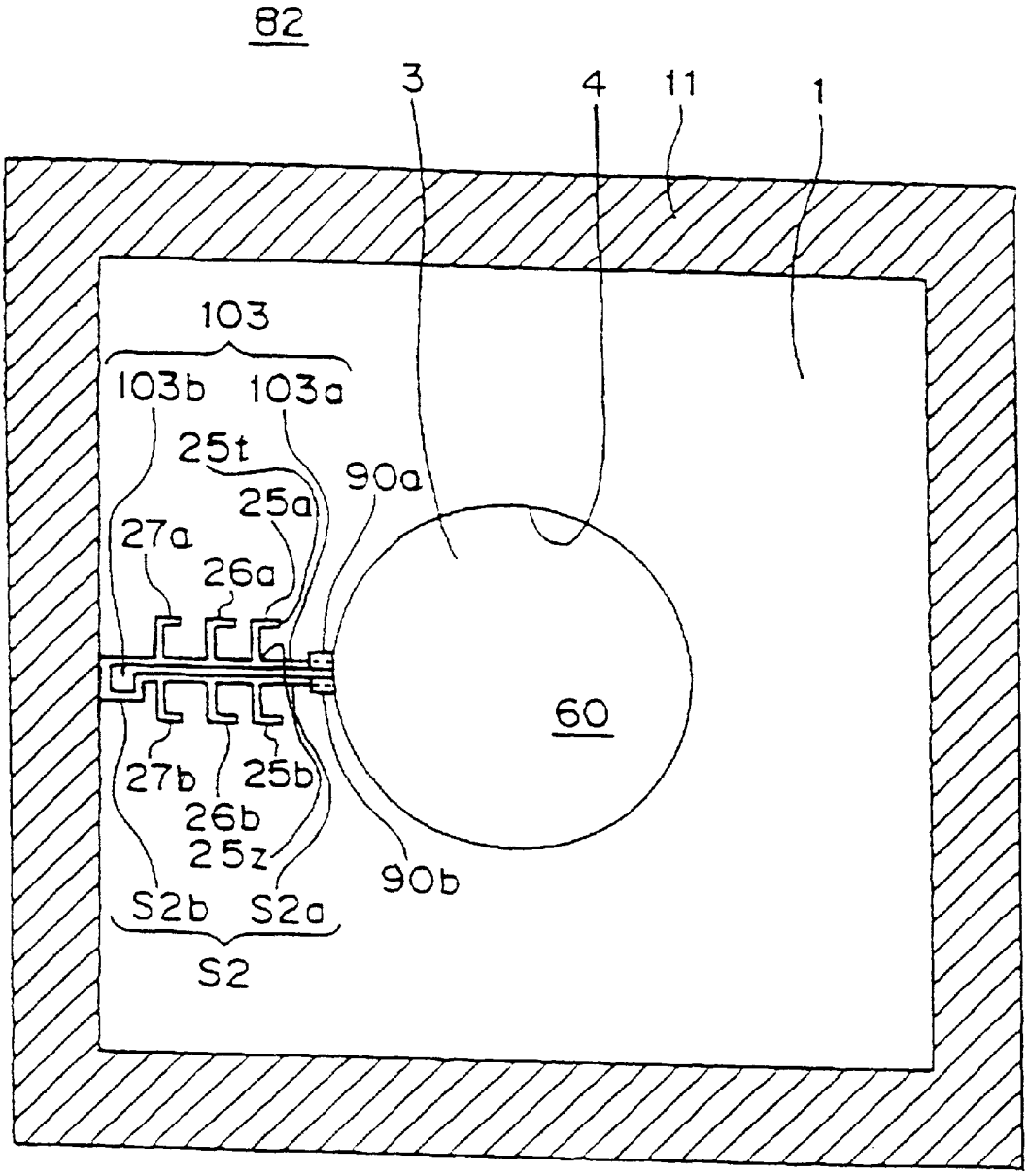
FIG. 10 is a cross-sectional view of a variable frequency dielectric resonator 82 which represents a second embodiment of the present invention.

FIG. 10 is a cross-sectional view of a variable frequency dielectric resonator 82 which represents a second embodiment of the present invention. FIG. 10 shows a section along a lateral plane between variable capacitors 90*a* and 90*b* and an upper conductor plate 211. The variable frequency dielectric resonator 82 shown in FIG. 10 differs from the variable frequency dielectric resonator 81 of the first embodiment in the following respects:

(1) A slit S2 is provided in place of the slit S1 shown in FIG. 1. The slit S2 is formed of a terminal formation slit S2*b* and a strip electrode formation slit S2*a*. The strip electrode formation slit S2*a* has sub-slits 25*a*, 25*b*, 26*a*, 26*b*, 27*a*, and 27*b*.

(2) A bias electrode 103 formed of a strip electrode 103*a* and a terminal electrode 103*b* is provided in place of the bias electrode 102 shown in FIG. 1.

(3) Variable capacitors 90*a* and 90*b* connected to the electrode 103*a* and an electrode 1 are provided in place of varactor diodes 70 and 71 shown in FIG. 1.

In the variable frequency dielectric resonator 82 shown in FIG. 10, the slit S2 is formed in the electrode 1 so as to connect with the opening 4. The slit S2 is formed of the strip electrode formation slit S2*a* which is defined by a predetermined length from its end open to the opening 4, which length is sufficiently larger than its width, and a terminal electrode formation slit S2*b* which is formed into a generally square shape and one side of which has a length larger than the width of the strip electrode formation slit S2*a*. The slit S2 is formed so that the lengthwise direction of the strip electrode formation slit S2*a* coincides with the direction normal to a circle defining the circumference of the opening 4.

In the strip electrode formation slit S2*a* of the slit S2, the pair of sub-slits 25*a* and 25*b*, the pair of sub-slits 26*a* and 26*b*, and the pair of sub-slits 27*a* and 27*b* are formed at intervals of about $\lambda g_1/4$ in the lengthwise direction of the strip electrode formation slit S2*a*. That is, the sub-slit 25*a* is formed so as to open into one side of the strip electrode formation slit S2*a* at a distance of $\lambda g_1/4$ from the position at which the slit S2 connects with the opening 4 while the sub-slit 25*b* is formed so as to open into the other side of the strip electrode formation slit S2*a* opposite from the sub-slit 25*a*. The symbol $\lambda g_1$ represents a propagation wavelength at the resonance frequency of the TE01O mode dielectric resonator 81*a* in a coplanar line formed with the strip electrode formation slit S2*a* and the strip electrode 102*a*. The sub-slits 26*a* and 26*b* and the sub-slits 27*a* and 27*b* have the same configuration as the sub-slits 25*a* and 25*b*.

Each of the sub-slits 25*a*, 26*a*, 27*a*, 25*b*, 26*b*, and 27*b* has a length of $\lambda g_2/4$ and is L-shaped. That is, each of the sub-slits 25*a*, 26*a*, 27*a*, 25*b*, 26*b*, and 27*b* is formed with a portion having a predetermined length from the end open to the strip electrode formation slit S2*a* and perpendicular to the lengthwise direction of the strip electrode formation slit S2*a*, and another portion set parallel to the lengthwise direction of the strip electrode formation slit S2*a* by being perpendicularly bent toward the opening 4. The symbol $\lambda g_2$ represents a propagation wavelength at the resonance frequency of the TE01O mode dielectric resonator 81*a* in slot lines formed by the sub-slits 25*a*, 26*a*, 27*a*, 25*b*, 26*b*, and 27*b*. The sub-slit 25*a* formed as described above forms a slot line shorted at the end 25*t* and having a length of $\lambda g_2/4$. The end 25*z* of the sub-slit 25*a* at which the sub-slit 25*a* connects with the strip electrode formation slit S2*a* can be regarded as an open end at the frequency corresponding to the propagation wavelength $\lambda g_2$, i.e., the resonance frequency of the $TE_{01O}$ mode dielectric resonator 81*a*, thus forming a trap circuit. The sub-slits 25*b*, 26*a*, 26*b*, 27*a*, and 27*b* have the same function as the sub-slit 25*a*. By these sub-slits, a resonance current flowing on the edge portion of the electrode 1 at the circumference of the opening 4 can be prevented from flowing into the bias electrode 103.

In the second embodiment of the present invention, each of the sub-slits 25*a*, 26*a*, 27*a*, 25*b*, 26*b*, and 27*b* is L-shaped. However, this is not indispensable to the present invention. For example, the sub-slits may be formed straight.

The bias electrode 103 is formed by connecting the generally-square terminal electrode 103*b* for connecting the bias conductor wire (not shown) and the strip electrode 103*a* smaller in width than the terminal electrode 103*b* and having a length sufficiently larger than its width. The bias conductor wire has its one end connected to the terminal electrode 103*b* and the other end connected to a variable voltage DC power source through a high-frequency coil or the like, for example. The bias electrode 103 is formed in the slit S2 while being insulated from the electrode 1. The bias electrode 103 is formed so that the terminal electrode 103*b* is positioned in the terminal electrode formation slit S2*b*, and so that the lengthwise direction of the strip electrode 103*a* is parallel to the lengthwise direction of the electrode formation slit S2*a*, with one end of the strip electrode 103*a* being positioned at the end of the slit S2 open to the opening 4.

The variable capacitors 90*a* and 90*b*, having the same construction, are connected to the strip electrode 103*a* and the electrode 1 in the vicinity of the end of the slit S2 open to the opening 4. The variable capacitor 90*a* is connected between an extreme end portion of the strip electrode 103*a* and a portion of the electrode 1 facing one of the two sides of the extreme end portion of the strip electrode 103*a* while the variable capacitor 90*b* is connected between the extreme end portion of the strip electrode 103*a* and a portion of the electrode 1 facing the other side of the extreme end portion of the strip electrode 103*a*. Thus, the variable capacitors 90*a* and 90*b* are connected in parallel with each other between the bias electrode 103 and the electrode 1.

Figure 11:
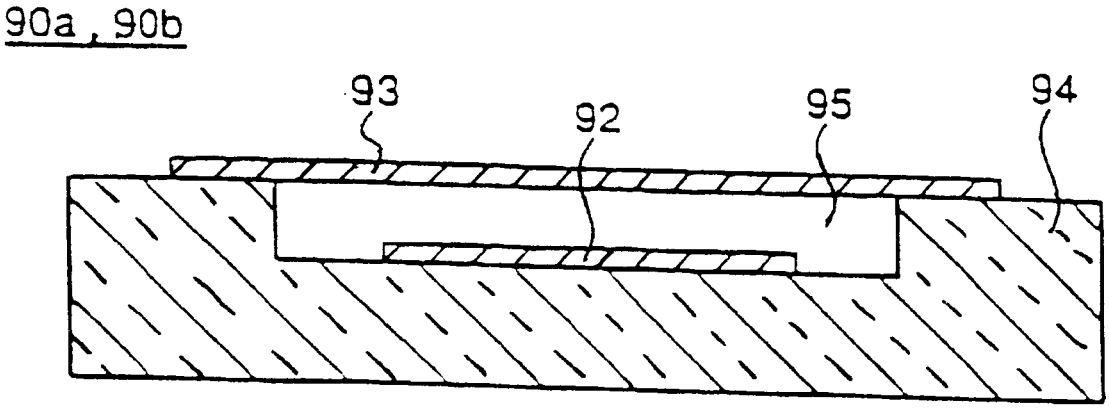
FIG. 11 is a longitudinal sectional view of variable capacitors 90*a* and 90*b* shown in FIG. 10.

As shown in FIG. 11, each of the variable capacitors 90*a* and 90*b* has a fixed electrode 92 and a movable electrode 93 each of which is formed as a thin-film conductor and which are supported on an insulating base 94 so as to face each other through a cavity 95 formed in the base 94. That is, the insulating base 94 is formed of, for example, a silicon substrate for forming a semiconductor device, and the fixed electrode 92 is formed by aluminum deposition or the like on the bottom surface of a recess formed by cutting the silicon substrate on the upper surface side. The movable electrode 93 is formed in the same manner over the opening of this recess so that its position is maintained in a floating state while facing the fixed electrode 92 through the cavity 95 formed therebetween. The fixed electrode 92 and the movable electrode 93 have terminal portions (not shown) formed so as to extend therefrom. A bias voltage is applied between these terminal portions. The shape of each of the fixed electrode 92 and the movable electrode 93 as viewed in plan can be freely selected. For example, it may be rectangular or circular. Also, the method of supporting these electrodes may be freely selected.

When a bias voltage is applied between the fixed electrode 92 and the movable electrode 93 in the variable capacitors 90*a* and 90*b* constructed as described above, the movable electrode 93 facing the fixed electrode 92 through the cavity 95 and supported in a floating state flexes relative to the fixed electrode 92 due to Coulomb force so as to change the distance between the fixed electrode 92 and the movable electrode 93. The electrostatic capacity between the fixed electrode 92 and the movable electrode 93 is thereby changed, thus obtaining the electrostatic capacity according to the applied bias voltage.

As described above, each of the variable capacitors 90*a* and 90*b* has the fixed electrode 92 and the movable electrode 93 facing each other through the cavity 95, and the electrostatic capacity is changed by changing the distance between the fixed electrode 92 and the movable electrode 93 through the Coulomb force. Because this effect is achieved without using a semiconductor device or the like having a comparatively large loss, the withstand voltage and the unloaded Q can be increased in comparison with the use of the varactor diodes 70 and 71 of the first embodiment.

In the variable frequency dielectric resonator 82 of the second embodiment constructed as described above, the variable capacitors 90*a* and 90*b* are connected in parallel between the edge portion of the electrode 1 on which a high-frequency current flows and the bias electrode 103 formed in the slit S2. Thus, the variable frequency dielectric resonator 82 can be represented by the equivalent circuit shown in FIG. 12, as in the case of the first embodiment. That is, it can be represented by a series connection of capacitance C10 and inductor L10 corresponding to the TE01O mode dielectric resonator 81*a* and variable capacitor C1 corresponding to the variable capacitors 90*a* and 90*b*.

Accordingly, the equivalent electrostatic capacity of the variable frequency dielectric resonator 82 expressed by the series connection of the capacitor C10 and the variable capacitor C1 is variable by changing the electrostatic capacity of the variable capacitors 90*a* and 90*b*. The electrostatic capacity of the variable capacitors 90*a* and 90*b* is changed by changing the voltage applied between the electrode 1 and the bias electrode 103 formed in the slit S2. The resonance frequency of the variable frequency dielectric resonator 82 is variable by changing the equivalent electrostatic capacity in this manner. If the equivalent electrostatic capacity of the variable frequency dielectric resonator 82 is increased, the resonance frequency of the variable frequency dielectric resonator 82 becomes lower. If the equivalent electrostatic capacity of the variable frequency dielectric resonator 82 is reduced, the resonance frequency of the variable frequency dielectric resonator 82 becomes higher.

The variable frequency dielectric resonator 82 of the second embodiment constructed as described above has the same advantages as the first embodiment and can have a higher unloaded Q than that of the first embodiment because the variable capacitors 90*a* and 90*b* having a higher unloaded Q than that of the varactor diodes 70 and 71 are used.

Examples of Modification

The first and second embodiments of the present invention have been described as a resonator using varactor diodes 70 and 71 and a resonator using variable capacitors 90*a* and 90*b*. According to the present invention, however, a switching device such as a PIN diode capable of operating in an on-off manner according to the direction of application of a bias voltage may be used in place of the varactor diodes or variable capacitors. If a variable frequency dielectric resonator is constructed by replacing each of the varactor diodes 70 and 71 with such a switching device, the resonance frequency can be changed in correspondence with the on-off operation of the switching device and the variable frequency dielectric resonator can be applied to a frequency shift keying (FSK) modulator, for example.

In the first and second embodiments, openings 4 and 5 are formed into a circular shape. According to the present invention, however, openings 4 and 5 may alternatively be formed into any other shape, e.g., a square or polygonal shape. Even in such a case, the resonator can operate in the same manner and as advantageously as the first and second embodiments.

The first and second embodiments have been described as resonators using conductor case 11. However, the present invention is not limited to this and only upper and lower conductor plates may be used in place of the conductor case 11. Even in such a case, the resonator can operate in the same manner and as advantageously as the first and second embodiments.

Third Embodiment

Figure 14:
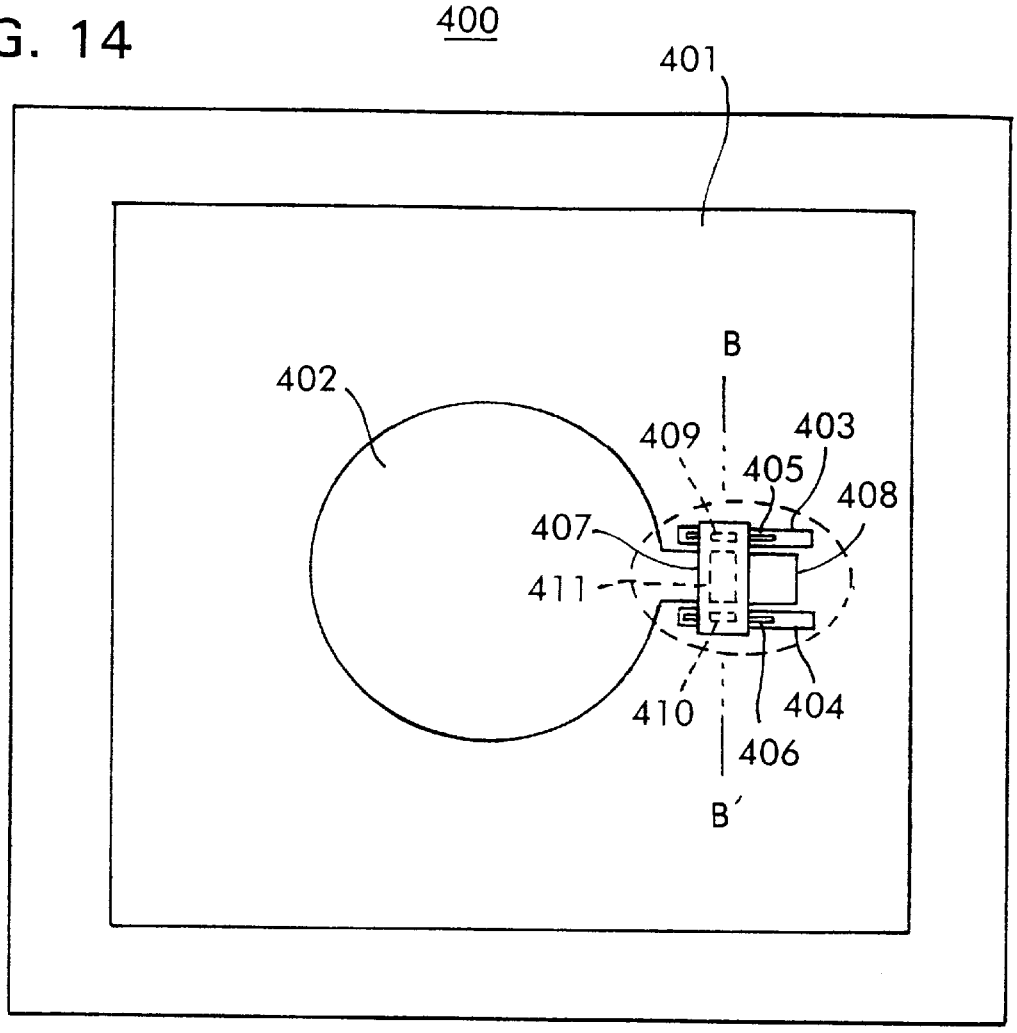
FIG. 14 is a cross-sectional view of a variable frequency dielectric resonator 400 which represents a third embodiment of the present invention.
Figure 14A:
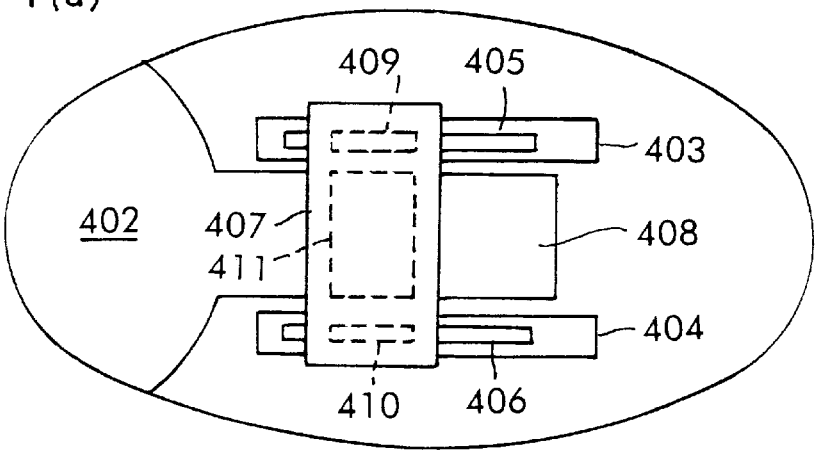
FIG. 14(a) is a detail view showing a portion of FIG. 14.
Figure 15:
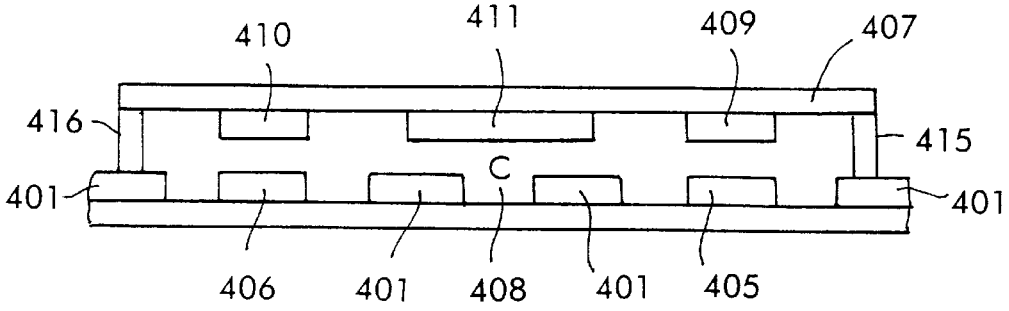
FIG. 15 is a longitudinal sectional view taken along the line B-B' of FIG. 14.

FIG. 14 is a cross-sectional view of a variable frequency dielectric resonator 400 which represents a third embodiment of the present invention. FIG. 14 (A) is a detail view showing a portion of FIG. 14(a) is a detail view showing a portion of FIG. 14 on a larger scale. FIG. 15 is a longitudinal sectional view of taken along the line B-B' of FIG. 14.

The resonator differs from the variable frequency dielectric resonator 81 of the first embodiment in the following respects:

A pair of openings 403 and 404 are provided in an electrode 401. Electrodes 405 and 406 which are separated from the electrode 401 are provided in the openings 403 and 404 respectively. Over the openings 403 and 404, and a slit 408, a thin insulating substrate 407 is disposed. The substrate 407 is received by support members 415 and 416. On the lower surface of the substrate 407, electrodes 409, 410 and 411 are disposed so that electrodes 409 and 410 oppose the electrodes 405 and 406 respectively, and the electrode 411 opposes the slit 408.

When voltage is applied to the electrodes 405 and 409, these electrodes attract each other. The substrate 407 is made of material having appropriate flexibility so that the substrate is bent downward. As a result, the distance between the electrode 411 and the slit 408 decreases where the capacitance of a capacitor C is formed by the electrode 411 and the electrode 401, and the capacitance therebetween increases.

Fourth Embodiment

Figure 16:
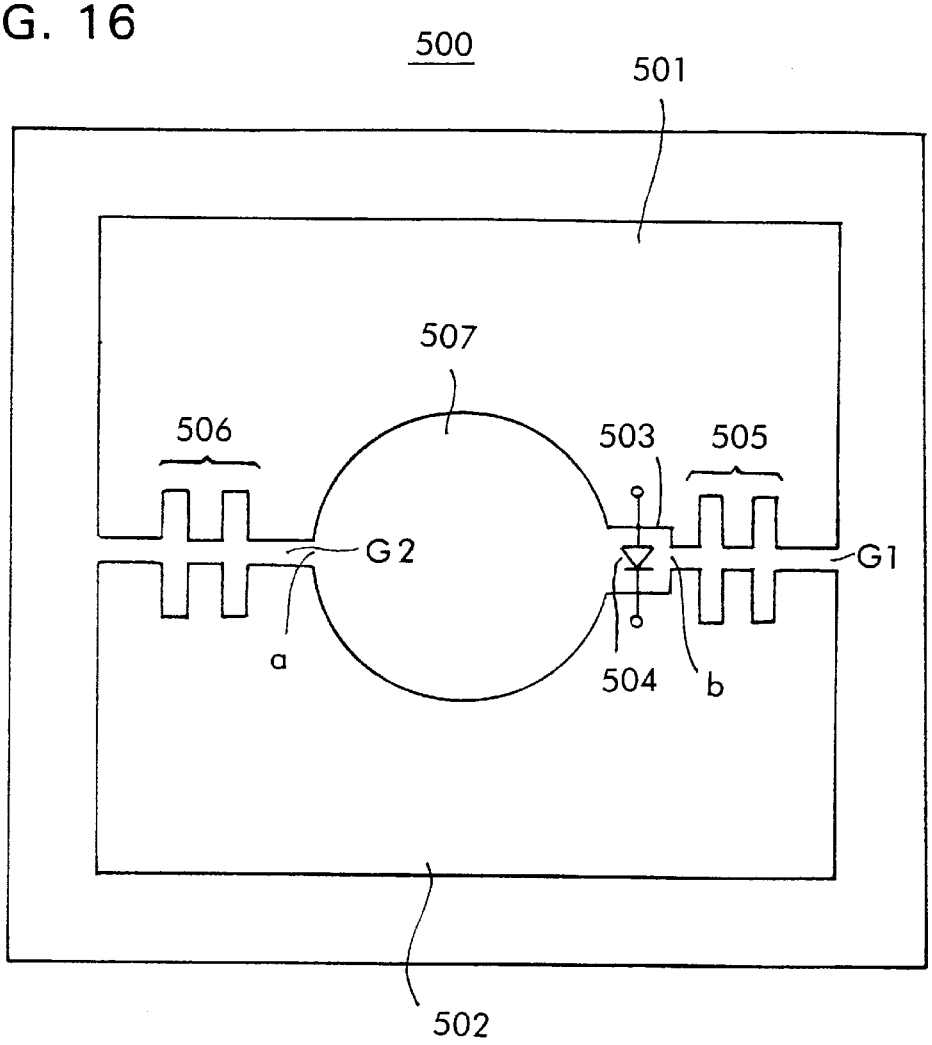
FIG. 16 is a cross sectional view of a variable frequency dielectric resonator 500 which represents a fourth embodiment of the present invention.

FIG. 16 is a cross sectional view of a variable frequency dielectric resonator 500 which represents a fourth embodiment of the present invention.

The resonator differs from the variable frequency dielectric resonator 81 of the first embodiment in the following respects:

In the variable frequency resonator, a single variable capacitor 504 has input and output terminals which are connected to separate electrodes 501 and 502. By changing the voltage applied to the variable capacitor 504, the resonant frequency of the resonator can be changed. Gaps G1 and G2 are provided to separate the electrodes 501 and 502. If merely gaps are provided without filters 505 and 506, electromagnetic energy confined in a resonator region escapes through the gaps to cause lowering of the Q value of the resonator. To avoid the escape of the electromagnetic energy, it is preferable to provide filters 505 and 506 along with the gaps G1 and G2, so that points "a" and "b", at which gaps G1 and G2 are connected to the slit 504 and the resonator region 507, can be regarded as shortened ends at the resonant frequency of the resonator 500. Various shapes of the filters 505 and 506 can be possible in accordance with the resonant frequency of the resonator 500.

Fifth Embodiment

Figure 17:
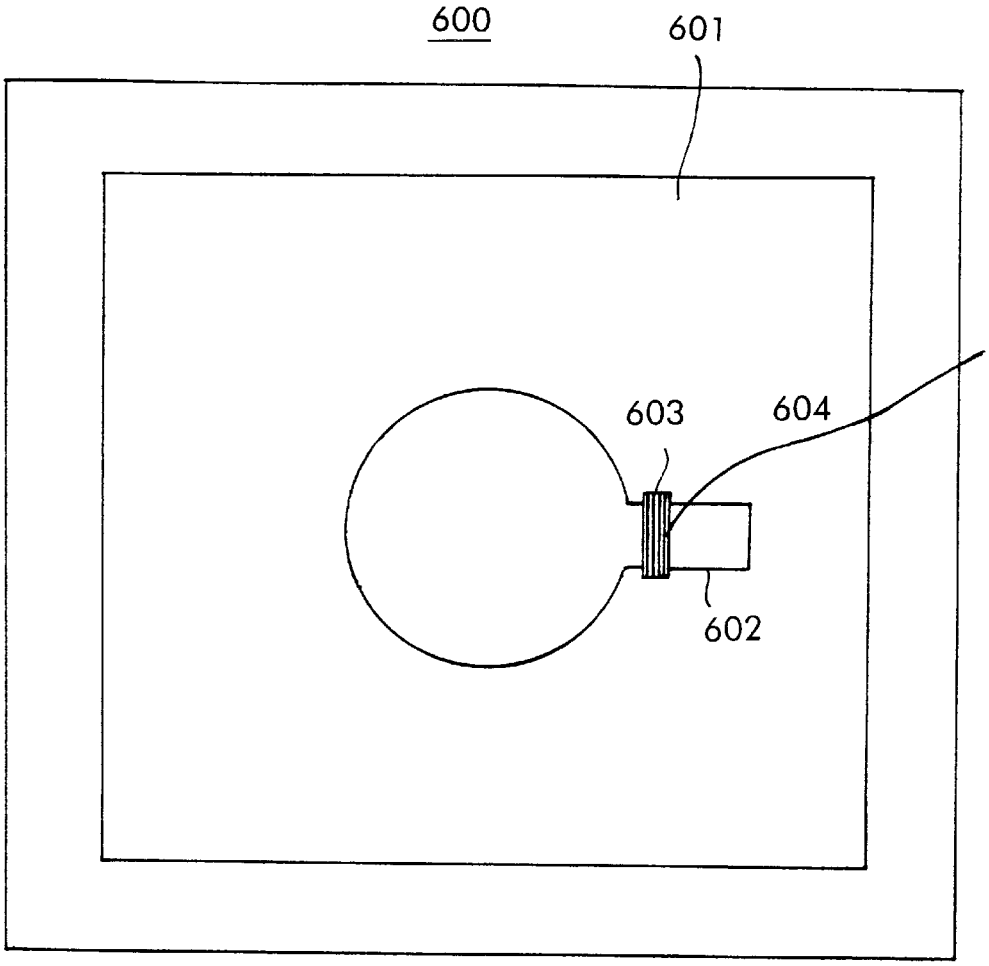
FIG. 17 is a cross-sectional view of a variable frequency dielectric resonator 600 which represents a fifth embodiment of the present invention.
Figure 18:
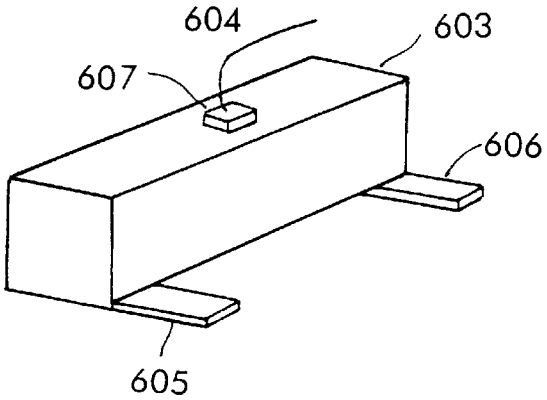
FIG. 18 is a perspective view of a variable capacitor device 603.

FIG. 17 is a cross-sectional view of a variable frequency dielectric resonator 600 which represents a fifth embodiment of the present invention.

Figure 19:
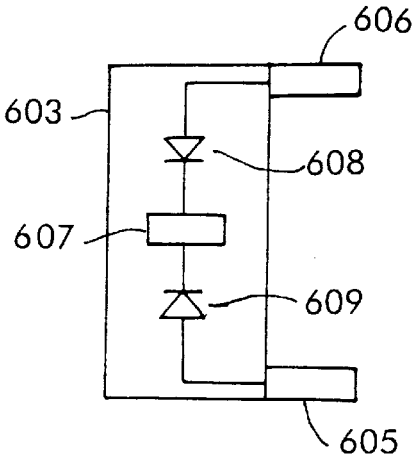
FIG. 19 is a circuit diagram of the variable capacitor device 603.

The resonator differs from the variable frequency dielectric resonator 81 of the first embodiment in the following respects:

Over a part of a slit 602 is disposed a variable capacitor device 603 whose circuit diagram is shown in FIG. 19. Two variable capacitors 608 and 609 are implemented in the device 603. Outputs of the variable capacitors share a single output terminal 607 to which a lead may be connected to apply voltage to the device. Other terminals of the variable capacitors are connected to an electrode 601 via terminals 606 and 607.

What is claimed is:

1. A dielectric resonator comprising:

a pair of upper and lower opposing conductive plates;

a dielectric substrate disposed between said conductive plates;

a first electrode disposed on one surface of said dielectric substrate, said first electrode having a first opening;

a second electrode disposed on another surface of said dielectric substrate, said second electrode having a second opening opposing said first opening whereby said dielectric substrate between said first and second openings defines a resonator;

a slit formed in said first electrode, said slit having opposing walls, said slit being connected to said resonator;

a third electrode being separated from said first electrode;

an insulating flexible substrate disposed above the third electrode and the slit;

a fourth electrode being disposed on the lower surface of the insulating flexible substrate so that the fourth electrode opposes said third electrode and so that said third and fourth electrodes are attracted to each other in response to a voltage applied across said third and fourth electrodes;

a fifth electrode being disposed on the lower surface of the insulating flexible substrate so that the fifth electrode opposes said slit.

2. A dielectric resonator according to claim 1, further comprising:

a support member disposed between said insulating flexible substrate and said first electrode.

3. A dielectric resonator comprising:

a pair of upper and lower opposing conductive plates;

a dielectric substrate disposed between said conductive plates;

a first electrode disposed on one surface of said dielectric substrate, said first electrode having a first opening;

a second electrode disposed on another surface of said dielectric substrate, said second electrode having a second opening opposing said first opening whereby said dielectric substrate between said first and second openings defines a resonator;

a first slit formed in said first electrode, said slit having opposing walls, said slit being connected to said resonator;

a second slit extending from said first slit to the outside of the first electrode;

a third slit extending from said first opening to the outside of the first electrode;

a first filter provided in the middle of the second slit for preventing electromagnetic energy from escaping to the outside of the resonator;

a second filter provided in the middle of the third slit for preventing electromagnetic energy from escaping to the outside of the resonator;

a variable capacitor connecting opposing walls of said first slit.

* * * * *